US010442574B2

(12) United States Patent
Kuchar et al.

(10) Patent No.: US 10,442,574 B2
(45) **Date of Patent: *Oct. 15, 2019**

(54) EXPANDABLE WEB MATERIAL FOR ENVELOPE CONSTRUCTION

(71) Applicant: KUCHARCO Corporation, Metuchen, NJ (US)

(72) Inventors: David M Kuchar, Metuchen, NJ (US); Matthew J. Kuchar, Metuchen, NJ (US)

(73) Assignee: KUCHARCO CORPORATION, Metuchen, NJ (US)

( * ) Notice: Subject to any disclaimer, the term of this patent is extended or adjusted under 35 U.S.C. 154(b) by 107 days.

This patent is subject to a terminal disclaimer.

(21) Appl. No.: 15/395,676

(22) Filed: Dec. 30, 2016

(65) Prior Publication Data

US 2017/0107017 A1 Apr. 20, 2017

Related U.S. Application Data

(63) Continuation-in-part of application No. 13/998,922, filed on Dec. 23, 2013, now Pat. No. 9,533,809, which is a continuation-in-part of application No. 12/755,316, filed on Apr. 6, 2010, now Pat. No. 8,613,993.

(60) Provisional application No. 61/260,807, filed on Nov. 12, 2009.

(51) Int. Cl.

| | |
|---|---|
| ***B32B 3/24*** | (2006.01) |
| ***B65D 27/00*** | (2006.01) |
| ***B65D 65/38*** | (2006.01) |
| ***B65D 81/34*** | (2006.01) |

(52) U.S. Cl.
CPC ..... *B65D 27/005* (2013.01); *B65D 65/38* (2013.01); *B65D 81/3461* (2013.01); *Y10T 428/24314* (2015.01)

(58) Field of Classification Search
CPC ..... B32B 3/26; Y10T 428/24314
See application file for complete search history.

(56) References Cited

U.S. PATENT DOCUMENTS

| | | | | |
|---|---|---|---|---|
| 2,656,291 | A | 10/1953 | Doll et al. | 428/129 |
| 3,655,501 | A | 4/1972 | Tesch | 428/136 |
| 3,958,751 | A | 5/1976 | Bruno | 229/87.08 |
| 4,803,128 | A | 2/1989 | Bender | 428/577 |
| 5,500,271 | A | 3/1996 | Pasch et al. | 428/135 |
| 5,538,778 | A | 7/1996 | Hurwitz et al. | 428/136 |
| 5,667,871 | A | 9/1997 | Goodrich et al. | 428/136 |
| 5,688,578 | A | 11/1997 | Goodrich | 428/136 |

(Continued)

FOREIGN PATENT DOCUMENTS

| | | | |
|---|---|---|---|
| AU | 2638892 | 5/1993 | E01F 13/00 |

*Primary Examiner* — William P Watkins, III
(74) *Attorney, Agent, or Firm* — Ernest D. Buff & Associates, LLC; Ernest D. Buff; Margaret A. LaCroix

(57) ABSTRACT

An envelope construct having at least two layers and at least two sheet layers and a tilde matrix core placed there between. The tilde matrix core formed as a slit web material having a straight or curvilinear structure that is substantially longer than it is wide, with specially shaped slits, "tilde-slits", which permit relatively easy expansion upon deployment. The expandable web material is especially well suited for construction of a light-weight, padded envelope that is durable and can withstand significant pressure during use.

20 Claims, 38 Drawing Sheets

(56) References Cited

U.S. PATENT DOCUMENTS

| | | | | |
|---|---|---|---|---|
| 6,929,843 | B2 | 8/2005 | Kuchar | 428/136 |
| 8,613,993 | B2 * | 12/2013 | Kuchar | D04D 9/00 229/87.01 |
| 9,533,809 | B2 * | 1/2017 | Kuchar | B65D 65/38 |

* cited by examiner

EXPANDABLE WEB MATERIAL FOR ENVELOPE CONSTRUCTION

This is a Continuation-In-Part of U.S. patent application Ser. No. 13/998,922 filed on Dec. 23, 2013, entitled "Expandable Web Material Having Curvilinear Structure" which, in turn, is a Continuation-In-Part of U.S. patent application Ser. No. 12/755,316 filed on Apr. 6, 2010, entitled "Expandable Web Material" which, in turn, is an improvement over U.S. Pat. No. 6,929,843, entitled "Fence Tape", issued on Aug. 16, 2005 which, in turn, is based upon U.S. patent application Ser. No. 10/605,028 filed on Sep. 2, 2003. It is also related to U.S. Provisional Patent Application Ser. No. 61/260,807 filed on Nov. 12, 2009 by Matthew Kuchar and the Applicant, entitled "Apparatus to Deploy and Expand Web Material", disclosures of which are hereby incorporated in their entirety by reference thereto.

BACKGROUND OF THE INVENTION

1. Field of the Invention

The present invention relates to envelope, envelope bags and sleeve constructions; and, more particularly, to envelope, envelope bags and sleeve constructions using expandable web sheet materials.

2. Description of the Prior Art

U.S. Pat. No. 6,929,843 or the Fence Tape Patent discloses and claims a tape barrier consisting of flexible material having generally parallel edges and substantially greater length than width. Cuts are made into the tape at intervals along the tape, forming slits that define cross members that extend generally along the length of the tape. The slits may be completed cuts so that the cross members are free to fall away from the tape on perforations that enable the cross members to be separated from the tape by tearing along the perforations. When the tape is deployed generally horizontally, the cross members fall vertically to provide cross members along the length of the resulting tape structure.

The contemplated use of the product taught in the Fence Tape Patent is a flexible plastic barrier tape segment cut from a continuous roll of tape. The ends of the segment are affixed to two mounting elements (e.g., vertical posts). A user then grasps the bottom of the tape segment, and pulls in a horizontal direction. As a result, the tape segment expands vertically to form a lattice or fence type structure with horizontal and vertical elements that create square voids. It is important to note that the tape expands in only one direction (i.e., vertical), while the other direction (i.e., horizontal) retains a constant length. The tape expands in width only, and does not expand in the longitudinal direction.

Australian Patent Application Serial No. 199226388 A1, filed by Gregory Beaumont on Oct. 14, 1992, teaches a safety net produced from a sheet of plastic material that has been slit to produce a formation of two repeating polygon shaped openings when expanded by tensioning opposite edges. The Beaumont application contemplates use of the invention as a fence barrier.

Sheet material that produces a lattice structure when pulled from opposite sides has been around for a while. Another example of such a product is taught in U.S. Pat. No. 2,656,291 issued to Doll, et.al. on Oct. 20, 1993. Doll discloses a slit sheet that when pulled, deploys to a lattice with rhombus shaped voids. Yet another example may be found in U.S. Pat. Nos. 5,667,871 and 5,688,578, both issued to Goodrich, et.al. on Sep. 16, 1997 and Nov. 18, 1997, respectively. Goodrich discloses a slit sheet of heavy paper that when pulled in opposite directions, expands into a lattice with hexagonal voids. A companion patent to Goodrich is U.S. Pat. No. 5,538,778 issued to Hurwitz, et.al. on Jul. 23, 1996. Doll, Hurwitz, and Goodrich contemplated use of their inventions as a packing material.

The Fence Tape Patent taught a continuous roll of material cut with specially shaped slits along the entire length of the material in the longitudinal direction, and which expands into a lattice structure when pulled in a single direction. In these prior art patents, the material expands in one direction while becoming narrower in the other direction.

The Fence Tape Patent does not limit its disclosure to traditional plastic barrier tape. The patent contemplates other uses for a continuous roll of slit material that deploys into a lattice. For example, if heavy paper is used, the material may deploy directly from the continuous roll into a packing material. Expansion of the material produces a lattice structure with square or rhombus shaped voids bounded by longitudinal members and cross members. The lattice structure produced has a unique advantage. The longitudinal members reside mainly in the plane of the paper, but the cross members twist into a non-coplanar direction. Therefore, if the material is rolled around an object, the rolled surfaces will be separated by a distance equal to the non-planar dimension of the cross members.

When used for envelopes and/or packing, much more material is required than for fence barriers, and the lattice dimensions need to be smaller. There are many more voids per unit area in the packing material than in the fence barrier. The problem with the continuous material produced with the fence tape patent for use as packing material is the difficulty of deploying (i.e., expanding) a sufficient quantity of material as it comes off the roll. As the roll unrolls, a user must pull on many sections in order to fully deploy the material. A single pull on the material expands it about six inches in width. Thus, a user needs to pull on the material repeatedly until it expands as desired. There is a need in the art for an envelope construction using expandable web materials that provides an optimal number of voids per unit area of envelope material and is easy to deploy as it unravels from a dispensing roll.

SUMMARY OF THE INVENTION

The present invention discloses envelope constructs made from a slit web material, substantially longer than it is wide, with specially shaped slits that permit relatively easy expansion upon deployment. The specially shaped slits are referred to in the Present Application as "tilde-slits," because they resemble a tilde mark. The cuts are arranged in continuous rows of tilde-slits. In any given row, the tilde-slits follow one-after-the-other in a linear direction. Adjacent rows of slits are parallel to each other, but are offset from one another such that a line drawn between adjacent tilde-slits in adjacent rows is not perpendicular to the direction of the rows. The invention contemplates that the material dispenses from a continuous roll. If the slits are arranged in the longitudinal direction, then the web material expands in the width direction only upon deployment. However, if the slits are arranged such that the row direction is at some angle to the longitudinal direction, then the web material expands in both directions upon deployment. In this case, a special dispenser is not required, and the material expands in both directions as it is pulled off the roll prior to cutting a desired length of material from the roll.

BRIEF DESCRIPTION OF DRAWINGS

The invention will be more fully understood and further advantages will become apparent when reference is had to the following detailed description and the accompanying drawings, in which:

FIG. 15A-15I show the numeric values of the variable parameters for an exemplary embodiment of the Present Invention, wherein:

FIG. 15A shows the horizontal dimensions of a tilde-slit;

FIG. 15B shows the vertical and angle dimensions of the tilde-slit;

FIG. 15C shows dimensions of a tilde-slit cut at an angle to the horizontal;

FIG. 15D shows dimensions of multiple adjacent rows of tilde-slits;

FIG. 15E shows dimensions of a single tilde-slit;

FIG. 15F shows dimensions of a single tilde-slit;

FIG. 15G shows dimensions of two adjacent rows of tilde-slits arranged along the longitudinal direction of the web material;

FIG. 15H shows dimensions of two adjacent rows of tilde-slits arranged at an angle to the longitudinal direction of the web material;

FIG. 15I shows dimensions of multiple adjacent rows of tilde-slits arranged at an angle to the longitudinal direction of the web material;

DESCRIPTION OF THE PREFERRED EMBODIMENTS

The present invention is directed to envelope constructs made from an expanded web material having either curvilinear or straight tilda matrix core structures, or combinations thereof. Envelope constructs herein include envelopes, envelope bags and/or sleeves adapted to be placed within traditional envelopes. Either curvilinear or straight tilda matrix cores can be used with any conventional style envelope construction starting with the outer layer of the envelope having an expanded tilda matrix core attached thereto produces a middle expanded layer topped with an additional inner layer of paper becomes the inside surface of the paper envelope.

Figure 10:
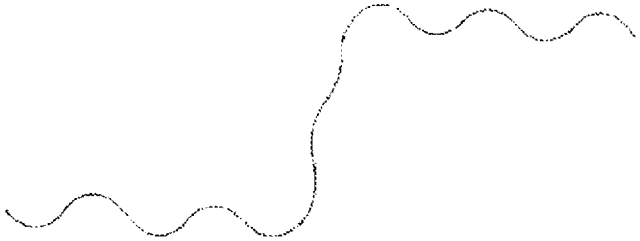
FIG. 10 illustrates an alternative embodiment of a tilde-slit.

The term tilde-slit, or tilda matrix, as used herein is generally defined as having the following shape. As set forth in U.S. patent application Ser. No. 12/755,316, entitled "Expandable Web Material", incorporated herein in its entirety by reference, and in reference to FIG. 1 and FIG. 2, the tilde-slit has two parallel straight cuts, 1 and 5 (see FIG. 1), that are cut at an angle β to the horizontal X-axis shown in FIG. 2. A central portion 3 extends at an angle θ to the horizontal X-axis. Between straight cut 1 and central portion 3, is a curved connecting portion 2, and between straight cut 5 and central portion 3, is a reverse curve 4, where 2 and 4 are X-Y double reversed mirror images of one another. The vertical Y distance between the ends of straight cut 1 and straight cut 5 is H. The horizontal X distance between the ends of straight cut 1 and straight cut 5 is W. FIG. 10 illustrates an alternative embodiment of a tilde-slit.

Figure 3:
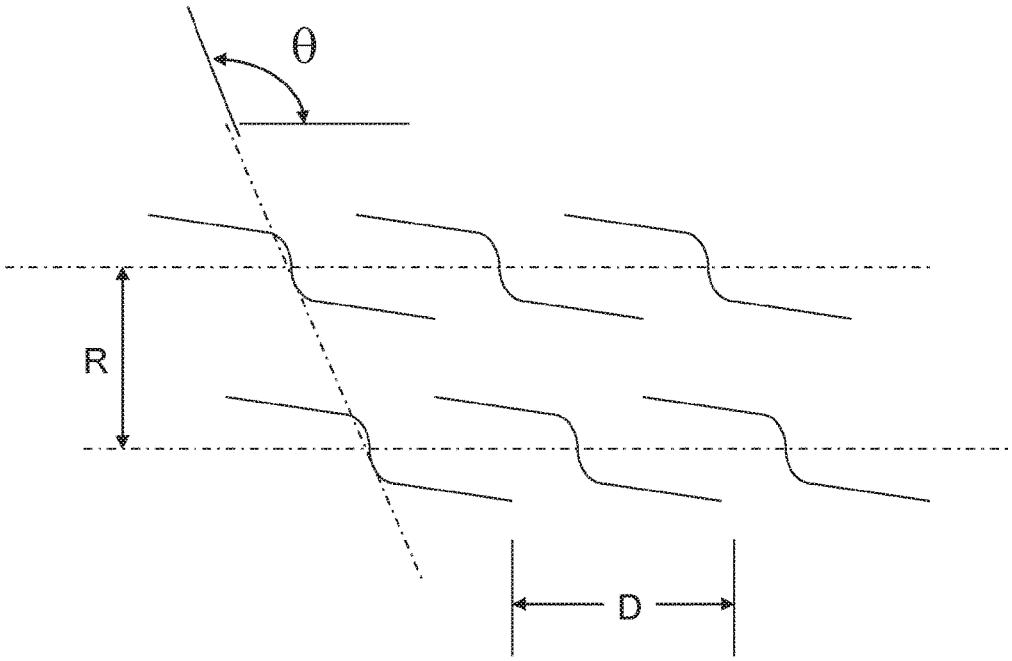
FIG. 3 illustrates two adjacent rows of tilde-slits arranged in the horizontal (or longitudinal) direction.

FIG. 3 illustrates two adjacent rows of tilde-slits of the previous Expandable Web Material disclosed in U.S. patent application Ser. No. 12/755,316. In the drawing, the two rows are parallel to each other along the horizontal X-direction. All of the tilde-slits are generally congruent. As used herein, the term "generally congruent" means having generally, but not exactly, the same over-all shape and size. The centers of all of the tilde-slits in any given row lie on the same straight line. However, there is an offset of the adjacent tilde-slits between adjacent rows. As shown in FIG. 3, a transversal is drawn at an angle θ to the two horizontal parallel lines, i.e., the centerlines of the two rows. The transversal intersects both parallel lines, and passes coincident with the center portion 3 of adjacent tilde-slits. That transversal line continues in both directions coincident with the center portion 3 of every adjacent tilde-slit in every row. Needless to say, parallel transversal lines at angle θ can be drawn through the center portion of any tilde-slit, and it will be coincident with the center portions of all adjacent tilde-slits. The distance between adjacent rows is R, and the distance between tilde-slits in a given row is D.

Figure 6:
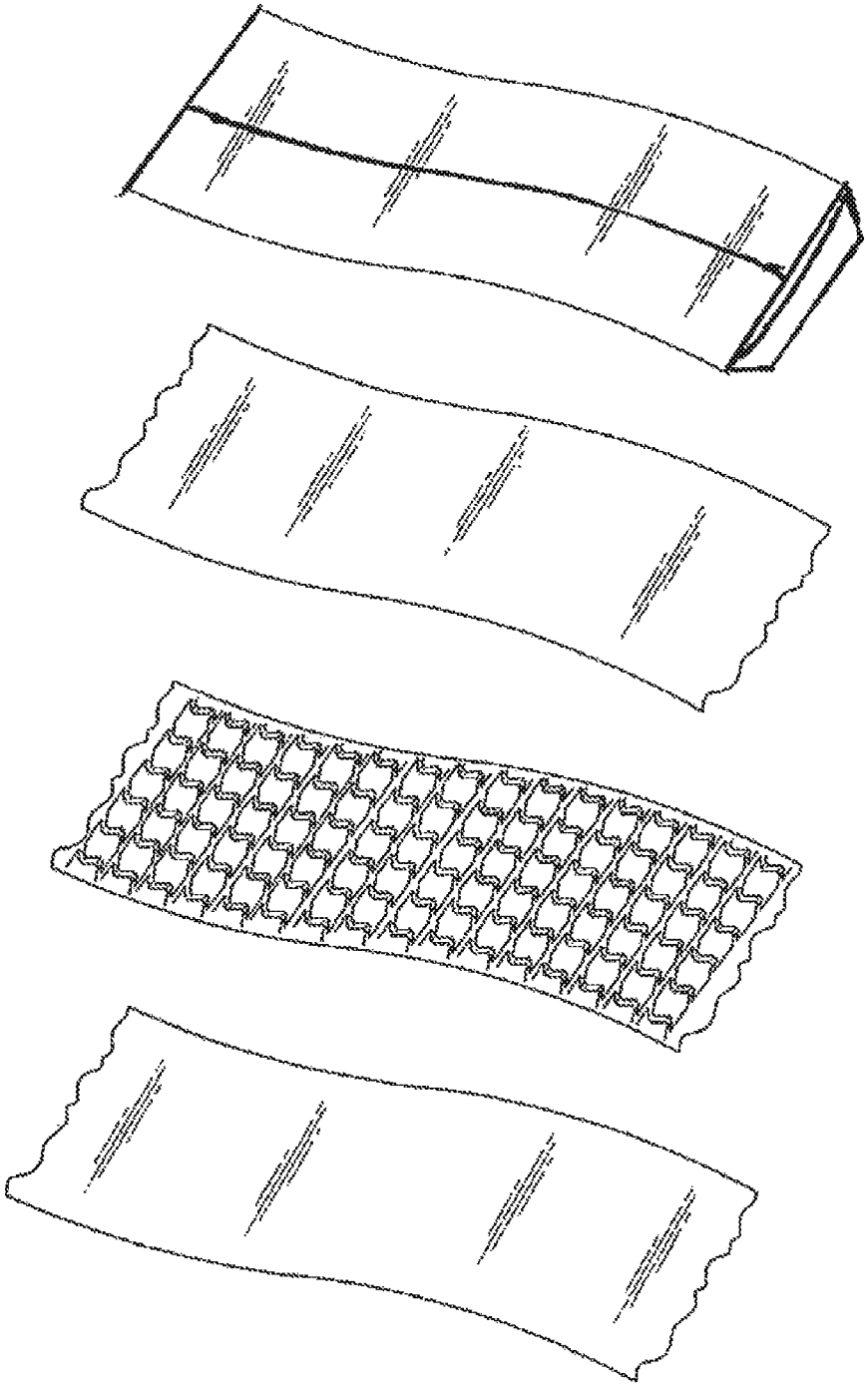
FIG. 6 illustrates a top view of a layering of the sheet material of the subject webbing material having curvilinear structure, showing a double layer of the webbing material.
Figure 7:
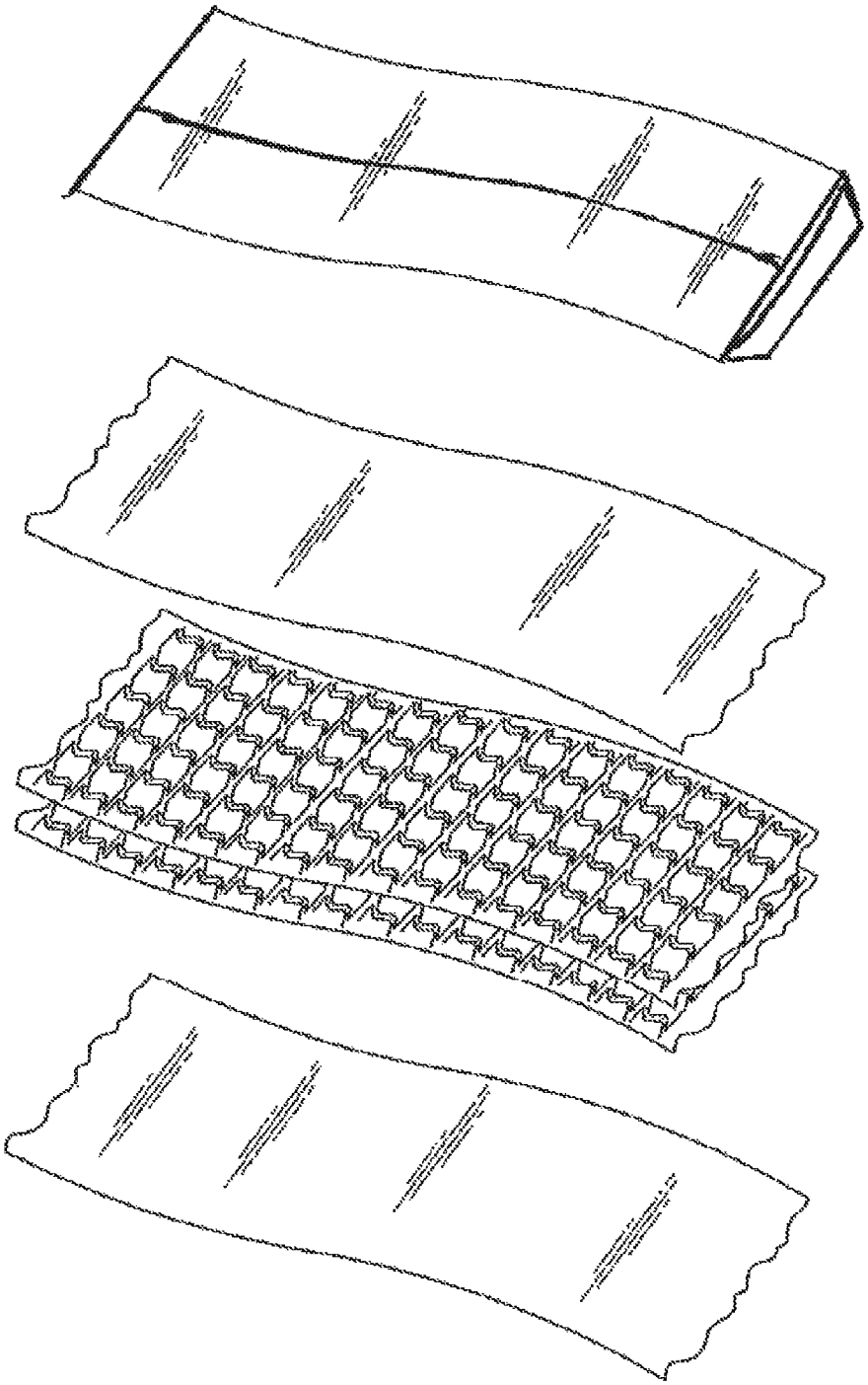
FIG. 7 illustrates a top view of a layering of the sheet material of the subject webbing material having curvilinear structure, showing a double layer of the webbing material.
Figure 11:
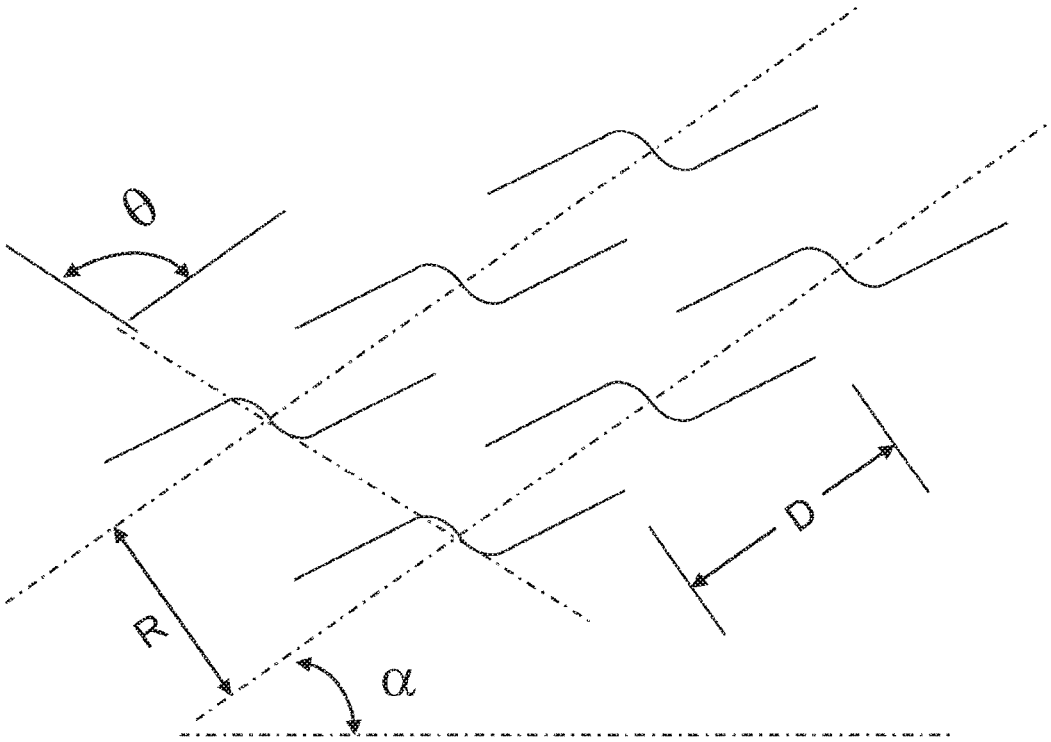
FIG. 11 illustrates two adjacent rows of tilde-slits arranged at some angle to the horizontal (or longitudinal) direction.

As discussed supra, there is an advantage to configuring the rows to run in a direction not parallel to the longitudinal direction (X-axis). If the tilde cuts are configured parallel to the longitudinal direction, expansion of the web material can only be in the width direction (Y-axis). However, if the parallel rows are configured at an angle α to the longitudinal direction (X-axis), as illustrated in FIGS. 6, 7, and 11, expansion is bi-directional. Either way, the final product is identical.

In the subject improved invention, a curved line rather than a straight line, as shown in FIG. 3 of the Expandable Web Material disclosed in U.S. patent application Ser. No. 12/755,316, is utilized for a transversal or a centerline, or both, yielding a novel curvilinear structure.

Figure 4A:
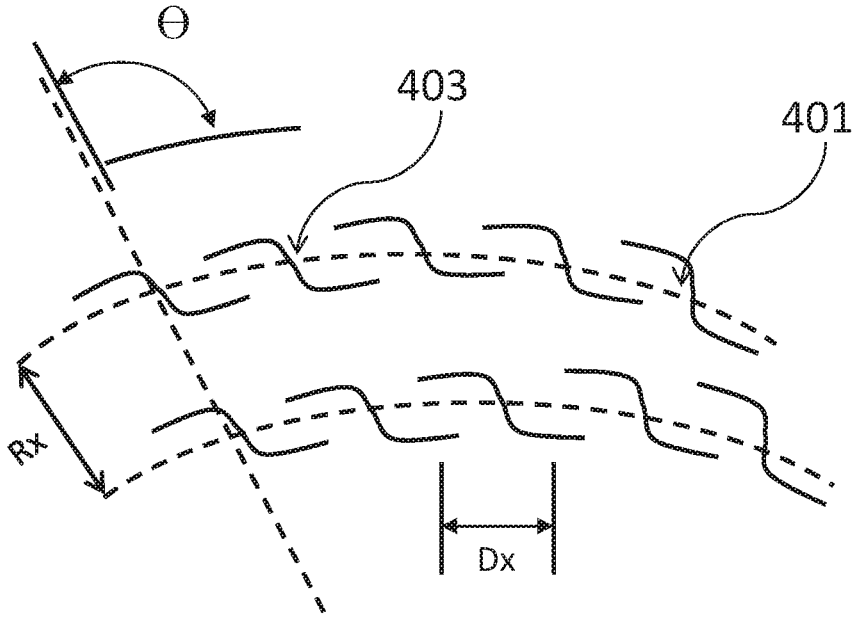
FIG. 4A illustrates two adjacent rows of tilde-slits arranged at some angle to the horizontal (or longitudinal) direction arranged in the horizontal (or longitudinal) direction illustrating the curvilinear structure of the subject webbing material.
Figure 4B:
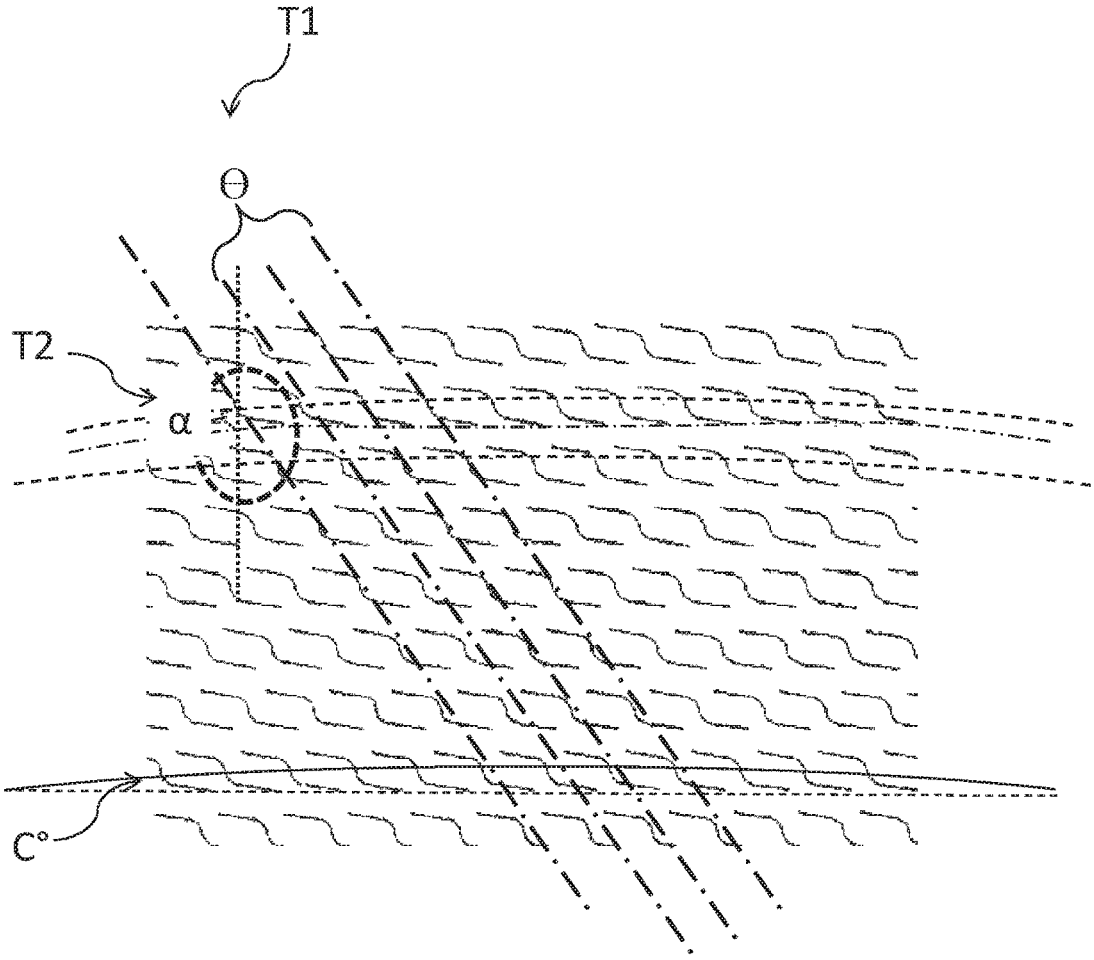
FIG. 4B illustrates a rectangular section of web material having curvilinear structure with the rows of tilde-slits arranged in the curved horizontal (or longitudinal) direction, the arrangement causing the slits to extend to the full width of the web.
Figure 5:
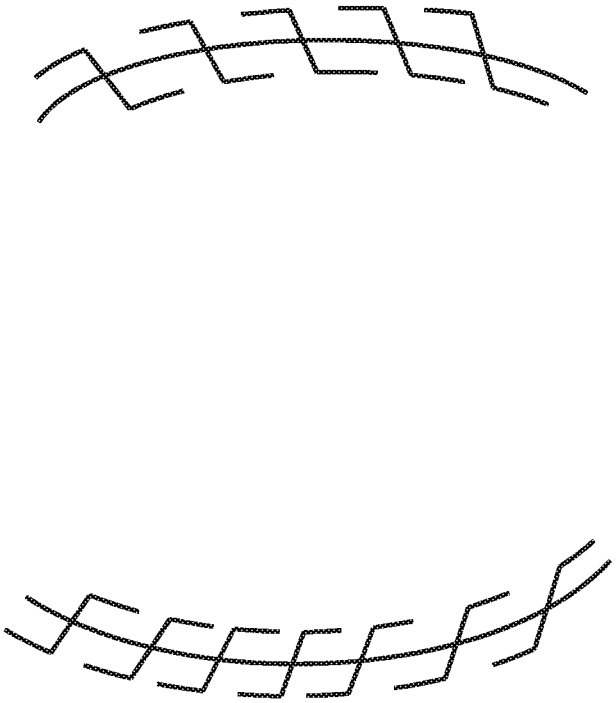
FIG. 5 illustrates a cross-sectional top view of a roll of webbing material, showing rows of tilde-slits arranged in the horizontal (or longitudinal) direction illustrating the curvilinear structure of the subject webbing material.
Figure 8:
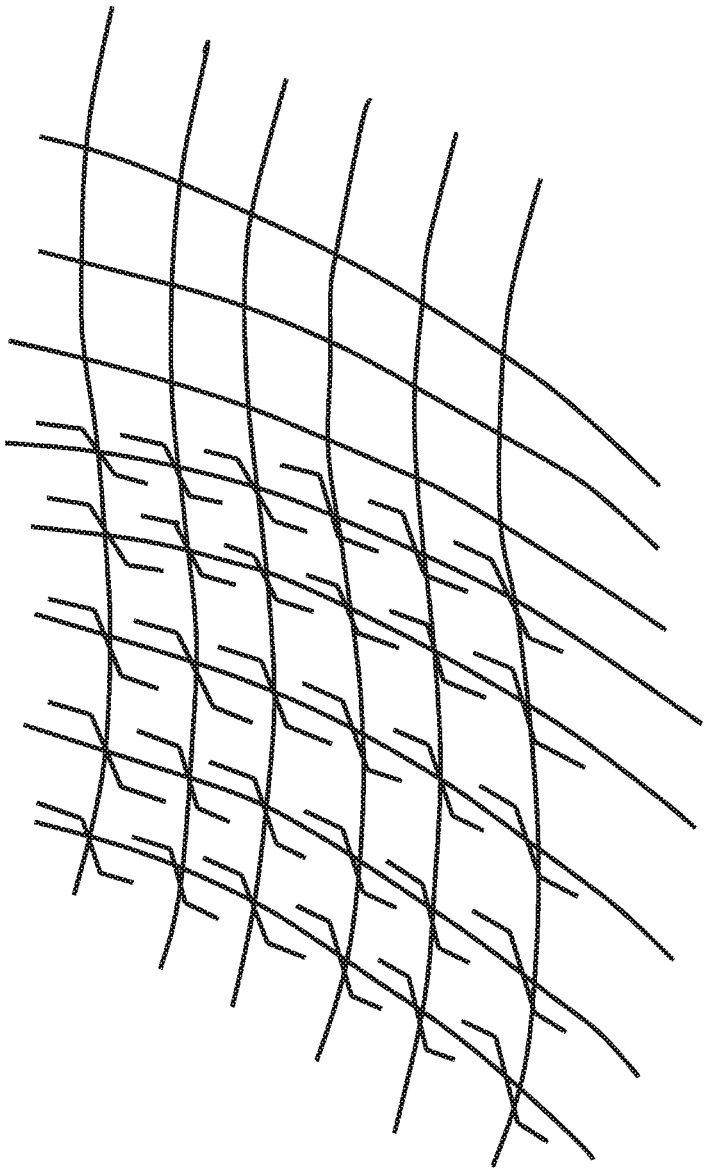
FIG. 8 illustrates a sectional top view of a sheet material of the subject webbing material having curvilinear structure.
Figure 9:
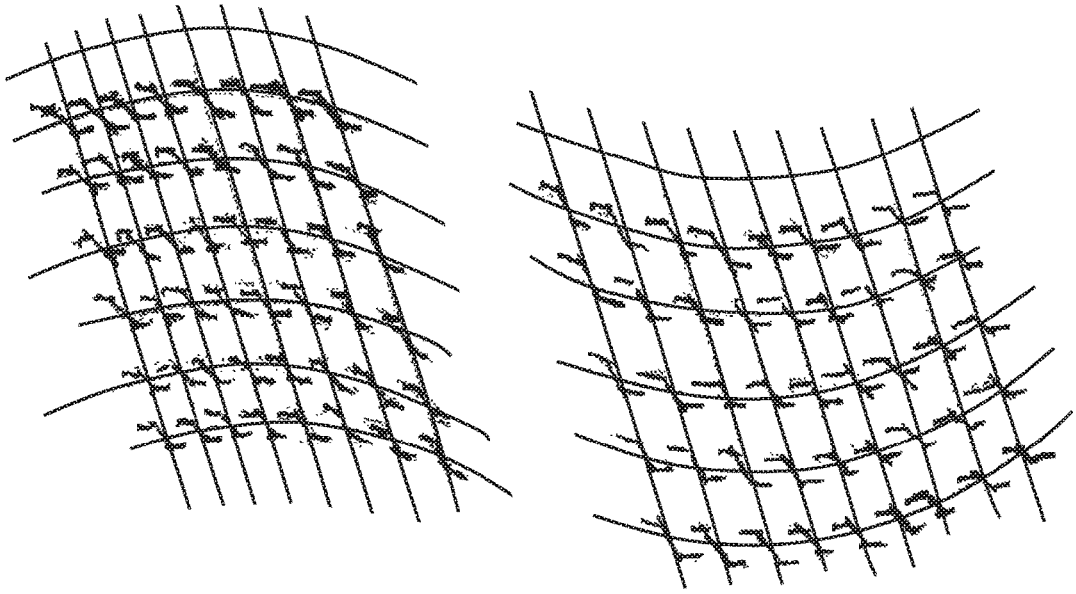
FIG. 9 illustrates a top view of a sheet material of the subject webbing material having curvilinear structure.

FIG. 4 illustrates the expanded web material with an optional curvilinear structure. FIG. 4A illustrates two adjacent rows of tilde-slits arranged in the horizontal (or longitudinal) direction illustrating the curvilinear structure of the subject webbing material. FIG. 4B illustrates a rectangular section of web material having curvilinear structure with the rows of tilde-slits arranged in the curved horizontal (or longitudinal) direction. With this material, the slits extend to the full width of the web. FIG. 5 illustrates a cross-sectional side view of a roll of webbing material, showing rows of tilde-slits arranged in the horizontal (or longitudinal) direction illustrating the curvilinear structure of the subject webbing material. FIG. 8 illustrates a sectional top view of a sheet material of the subject webbing material having curvilinear structure, while FIG. 9 illustrates a top view.

Referring to FIGS. 4-9, the two rows of tilde slits are arranged parallel to each other along the horizontal X-direction on a curve 401 to form a curvilinear structure. Centers of all of the tilde-slits in any given row lie on the same curved line, with an offset of the adjacent tilde-slits between adjacent rows. As shown in FIG. 4, a transversal is drawn at an angle θ to the two horizontal parallel curved lines, i.e., the curvilinear centerlines of the two rows. The transversal intersects both parallel curved lines, and passes coincident with the center portion 403 of adjacent tilde-slits. That transversal line continues in both directions coincident with the center portion 403 of every adjacent tilde-slit in every row. Parallel transversal lines at angle θ can be drawn through the center portion of any tilde-slit, and it will be coincident with the center portions of all adjacent tilde-slits. The distance between adjacent rows is Rx, and the distance between tilde-slits in a given row is Dx.

In FIG. 4B a first transversal T1 is shown intersecting the essentially parallel curved centerlines of the adjacent rows having an angle θ. Note that curved centerlines have a degree of curvature C°. A second transversal T2 is shown intersecting the transversals via parallel centerlines forming α. Second transversal T2 extends coincident to the center point of an adjacent row and intersects the first transversal T1 at an angle α to the longitudinal direction (x-axis). Second transversal T2 is not parallel to the longitudinal direction (x-axis) so that the tilde slit rows are offset The curvilinear structure via the curved line transversal can accommodate the expansion of expanded web material into square cell structures, which are arranged side by side and offset by means of the transversal as herein described. The curved section is scaled to the tilde size. It has been found that if the angle of curvature of the curved section is too large, then the size of the tilde must be increased to accommodate the greater distance between the parallel lines that locate the tilde cut. If the angle or curvature of the curved section is too small, then the tildes would be too close to one another for transfer of energy forces required to open them. This allows proper scaling of the curves that will accommodate the physical sizes of the tilde cuts when placed generally radially, perpendicularly and axially in a similar manner described hereinabove. This allows for perpendicular averaging of the tilde cuts to be located centrally on curved centerlines and curved transversals which are not precisely parallel; but which have an average distance there between.

With this arrangement, the curved centerlines or curved transversals of the tilde cuts' ends will reside within the matrix in an orderly array, thus allowing transfer of forces that deploy the web to a fully expanded state. An exact distance for each side of the tilde cut ends for any tilde cut placed on a curved centerline or transversal can be accomplished if the basic shape of the tilde cut is rotated slightly to allow for exact spacing of the tilde cuts ends from the curved centerline line placement and is adjusted slightly to accommodate for the variation of a straight line format grid compared to the curved grid format.

This curved line pattern matrix is not limited to curves of a single radius. It is not limited to reverse curves with variable radius. Any combination of centerlines that can successfully accommodate the basic parallelogram grid matrix shape as plotted along with typical tilde cuts, as previously described, will allow for a curved matrix creating side by side square shaped cells.

It will be understood that the pattern of expanded web material having a curved pattern relative to the curves will accommodate the variation of the tilde cuts as placed onto the new curved matrix pattern.

The tilde shapes' end-most sections can even follow the curved line format of the new centerlines on which they will reside with the leg ends of the tilde shape paralleling the curved centerlines modifying the basic tilde shape slightly, allowing expansion of the cells within the matrix.

With the curved centerline having a degree of curvature or curve angle (see FIG. 4B, C°) and transversals (T1, having angle θ) tildes within the matrix pattern can vary in height and width to accommodate a more exacting rail width dimension, as herein before described as consistent. Conversely, the rail width dimensions within the matrix will vary slightly using a pattern of tildes that have a single height dimension. Scaled properly, the matrix has particular utility for microscopic substrates, surfaces and/or substrates useful for anti-microbial proliferation, as well as other contemplated uses as set forth hereinafter.

The potential to generate unevenly spaced and semi-evenly spaced tilde cuts/generating cell with and without a random pattern is also possible. Also, possible using the same basic concepts for square cell generation is a combination of straight and curved lines for curve angles and transversals as described herein, having before described limits that will allow a pattern that can be combined to have straight lines that are generally parallel and curved lines that will vary forming an irregular matrix pattern. Particular uses include microbial control.

This tilde matrix application may be useful for envelope construction as a center expanded core filler between two sheets of paper or other suitable materials. FIG. 6 illustrates a top view of a layering of the sheet material of the subject webbing material having curvilinear structure, showing a double layer of the webbing material. FIG. 7 illustrates a top view of a layering of the sheet material of the subject webbing material having curvilinear structure, showing a double layer of the webbing material/multi ply construction. The webbing material has particular applications as padding in padded envelope construction using a distribution of core and relatively smooth outer surfaces to produce a tough padded material having flexibility with a degree of conformability. If used as sheet stock the webbing material having curvilinear structure becomes an excellent disposable padding for all types of parts being packed, protecting them in storage or shipment until used, while allowing the padding to be cut or converted into specific requirements for users. This tilde matrix application also is potentially useful for pillow construction. This combination affords breathability while controlling compression and set while supplying adequate support. Forces such as body weight and pillow rebound can be optimized using appropriate filler foams or the like, along with tilde matrix sheets composed of foam and arranged in a multi ply construction. Such a construction would also be appropriate for use in mattresses or other foam supporting structures, including those used to pack electronic equipment, musical instruments and the like.

Application of layering variable patterns will or can provide, upon expansion, additional support by varying and crossing of internal patterns akin to the laminated forms of various products, including cleaning pads, insulation, acoustic locks and other sound deadening devices, to increase support for these structures and form voids that trap or capture fine particulates or air pockets. Straight matrix patterns combined with variable patterns will or can yield the possibility for combined effects allowing for greater versatility for a myriad of diverse product applications.

Figure 12:
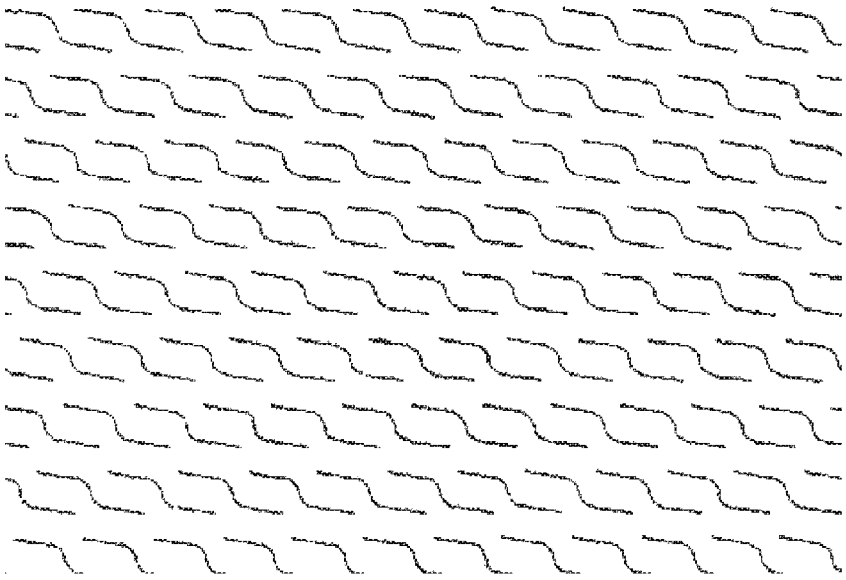
FIG. 12 illustrates a rectangular section of material with the rows of tilde-slits arranged in the horizontal (or longitudinal) direction, the arrangement causing the slits to extend to the full width of the web.
Figure 13:
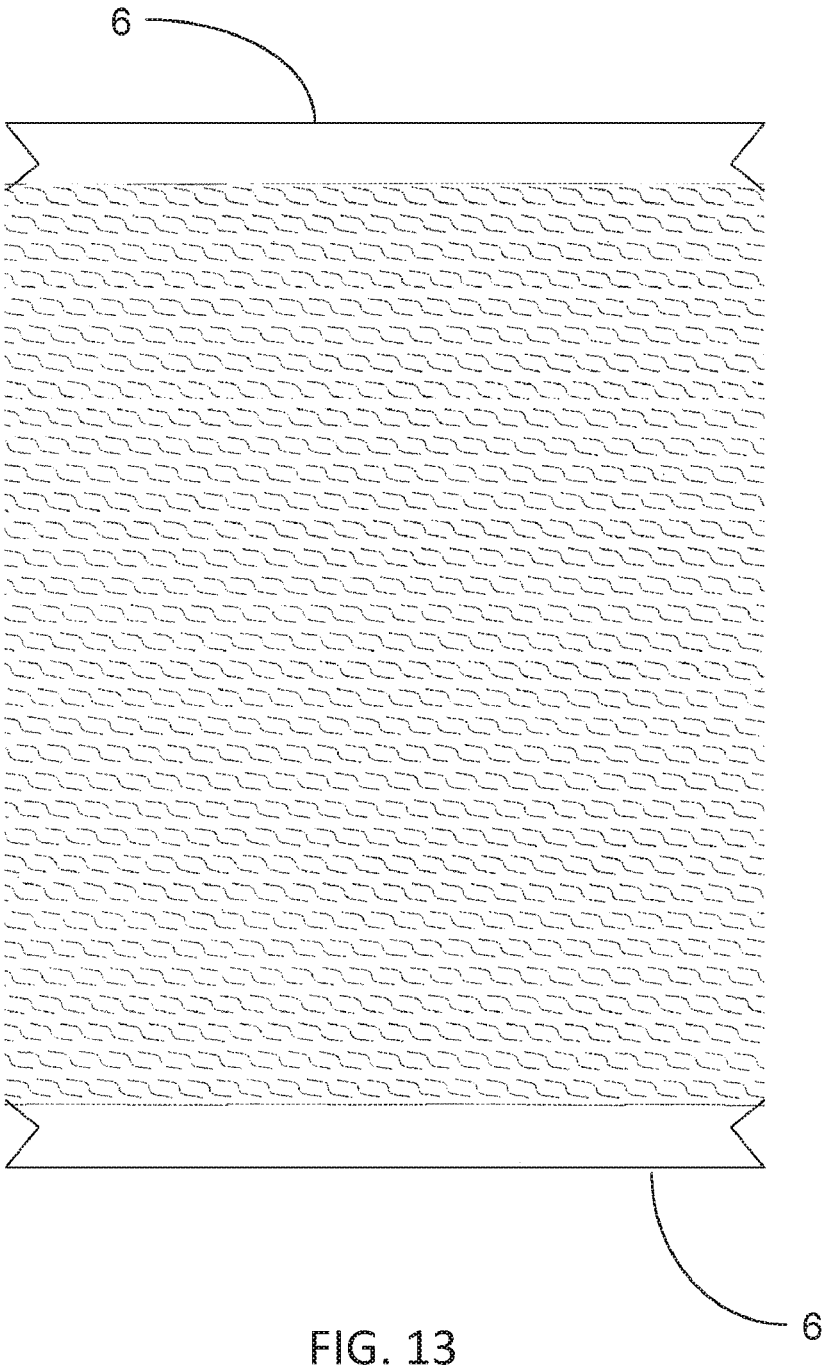
FIG. 13 illustrates a rectangular section of material with the rows of tilde-slits arranged in the horizontal (or longitudinal) direction, the arrangement being such that two borders (devoid of slits) run parallel to the longitudinal direction and are positioned on both sides of the width of the web.

FIG. 12 illustrates a portion of the web material showing the rows of tilde-slits configured in a direction parallel to the longitudinal axis. FIG. 13 illustrates the same thing. In both drawings, it must be noted that the tilde-slits are actual fine cuts in the web material. The difference between the two drawings is that in FIG. 12, the tilde cuts extend to the ends of the web material in the width direction. In FIG. 13, two "rails," 6, which are devoid of slits, run parallel to the longitudinal direction and are situated at the ends of the web material in the width direction. For the embodiment in FIG. 13, the two rails extend for the entire roll. The function of the rails is to make deployment by users easier. However, both configurations (i.e., of FIGS. 5 and 6) work equally well.

Figure 14A:
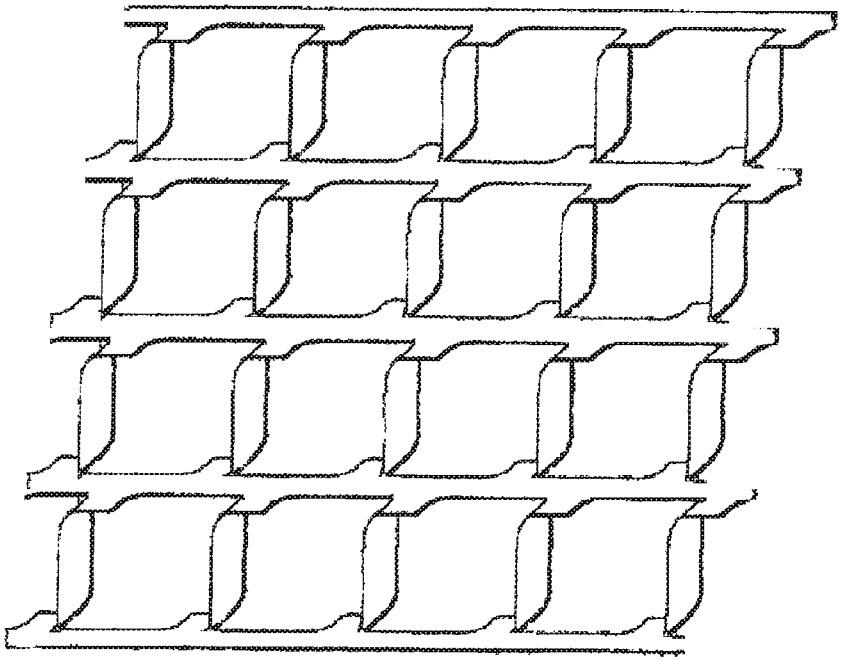
FIG. 14A illustrates a plan view of the expanded material.
Figure 14B:
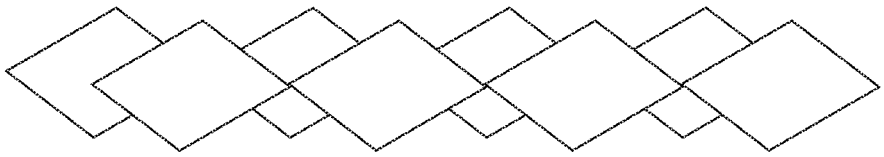
FIG. 14B shows an edge view of the expanded material.
Figure 15A:
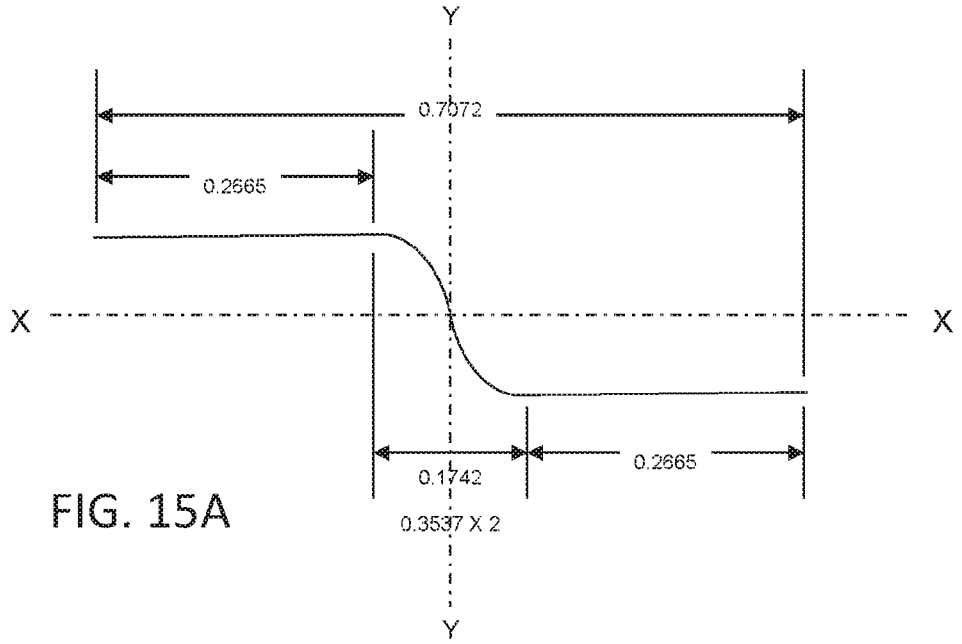
Figure 15B:
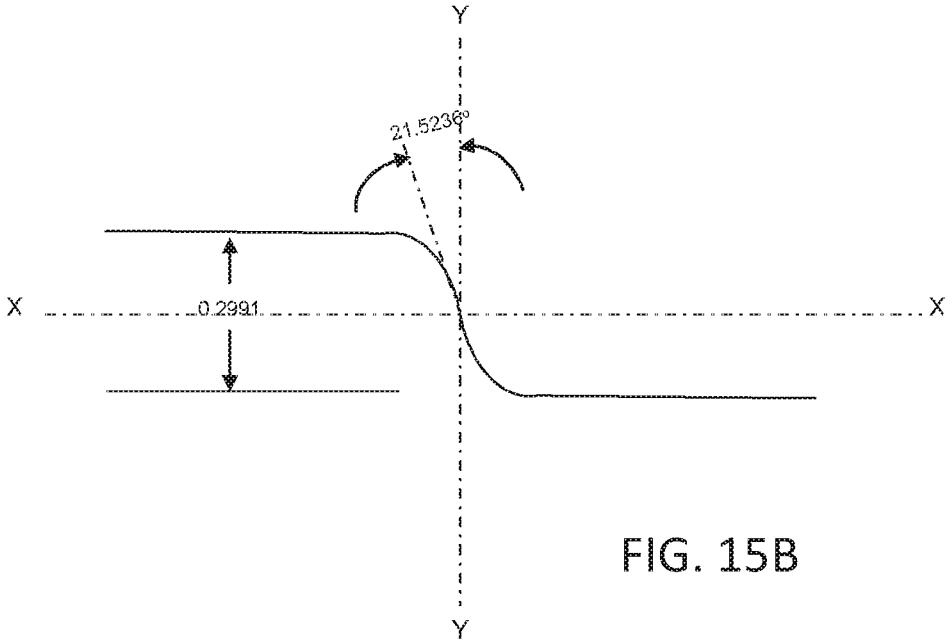
Figure 15C:
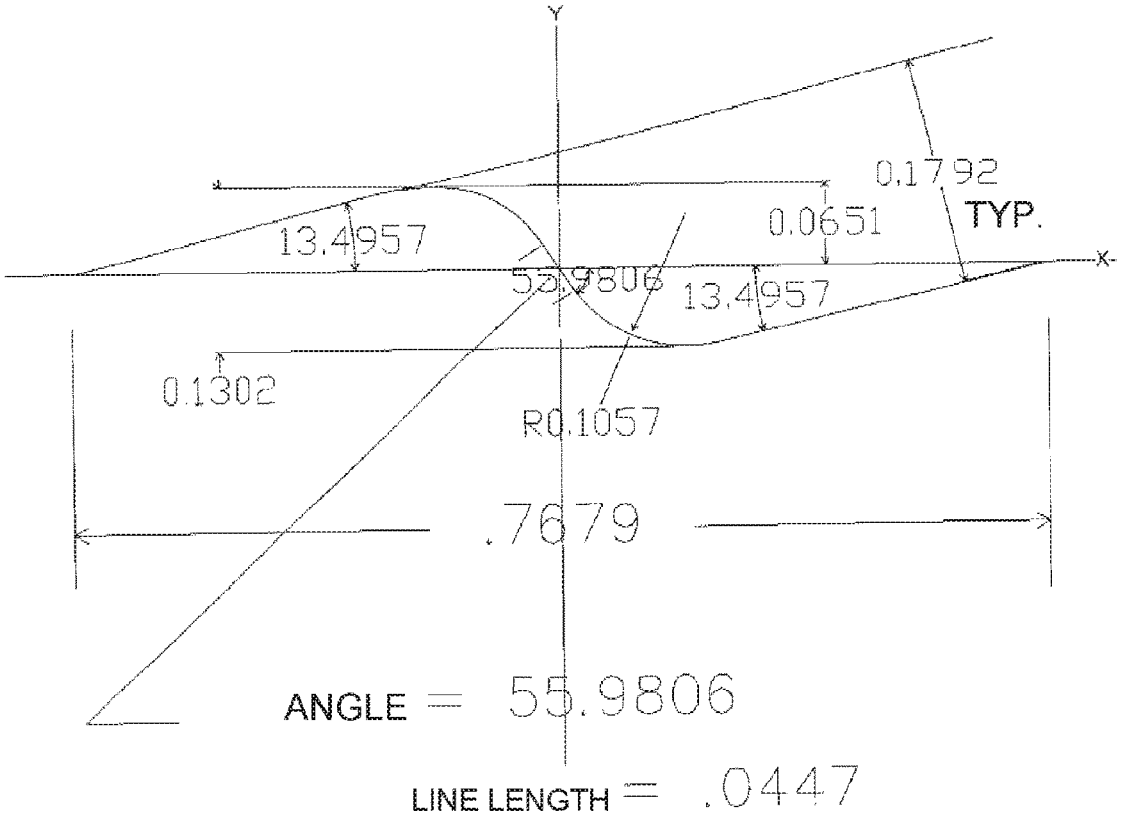
Figure 15D:
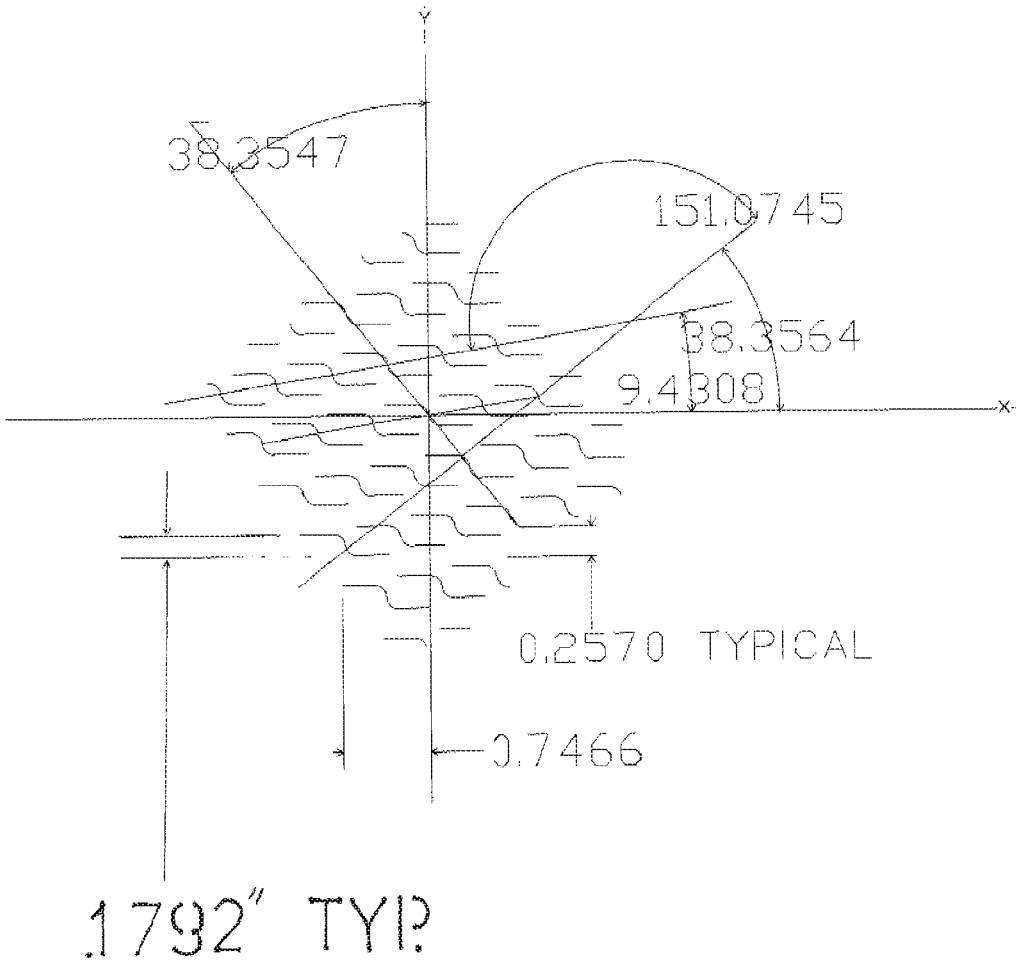
Figure 15E:
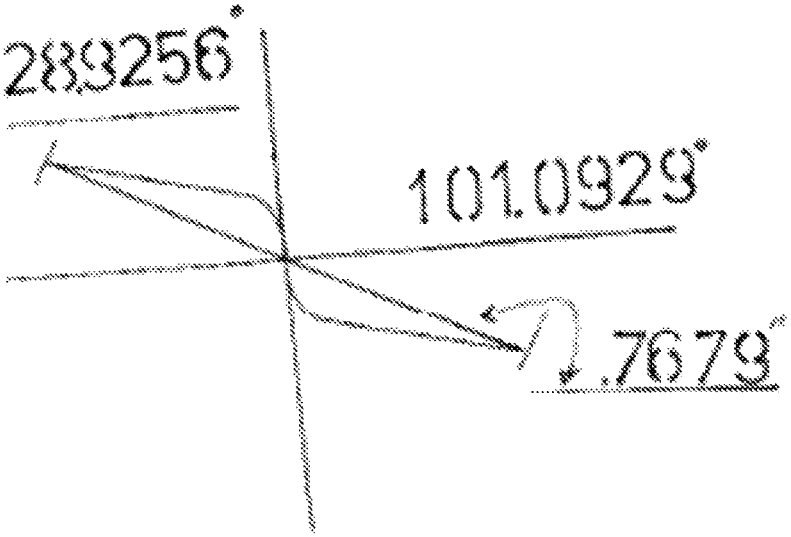
Figure 15F:
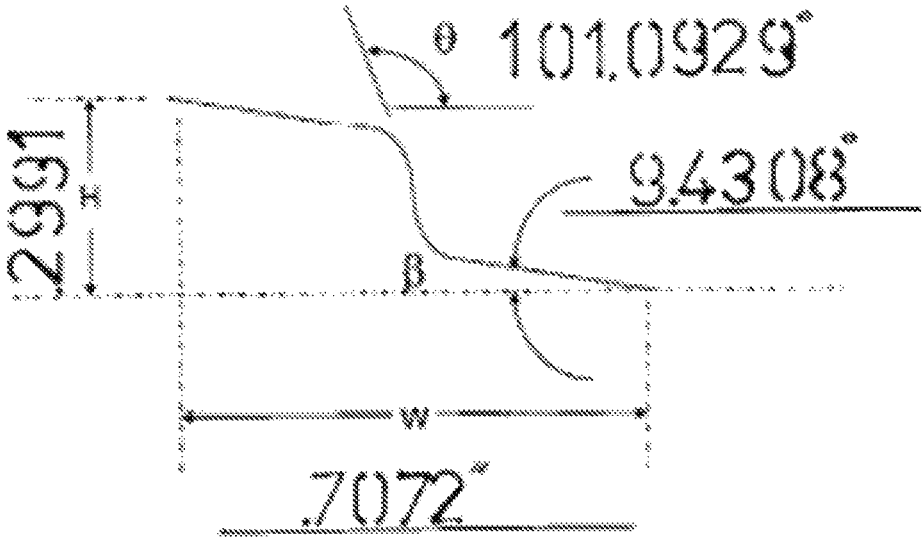
Figure 15G:
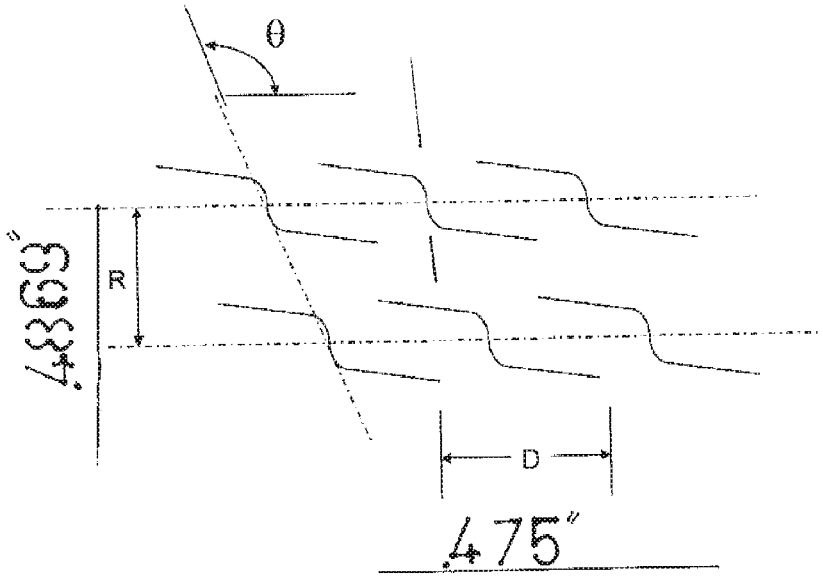
Figure 15H:
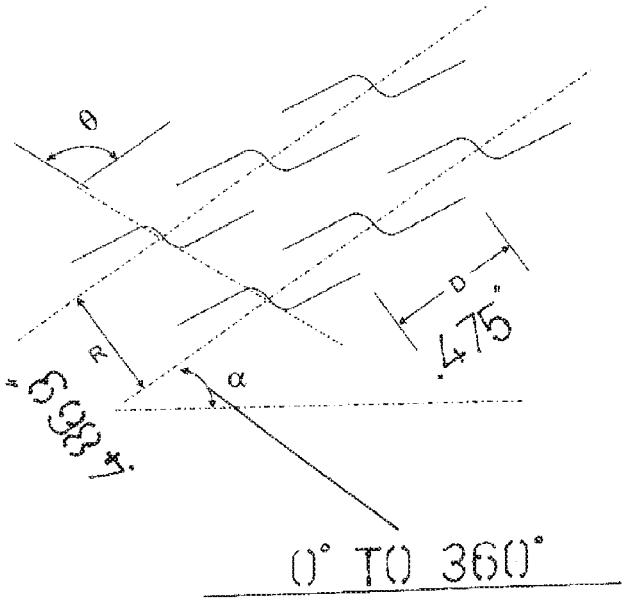
Figure 15I:
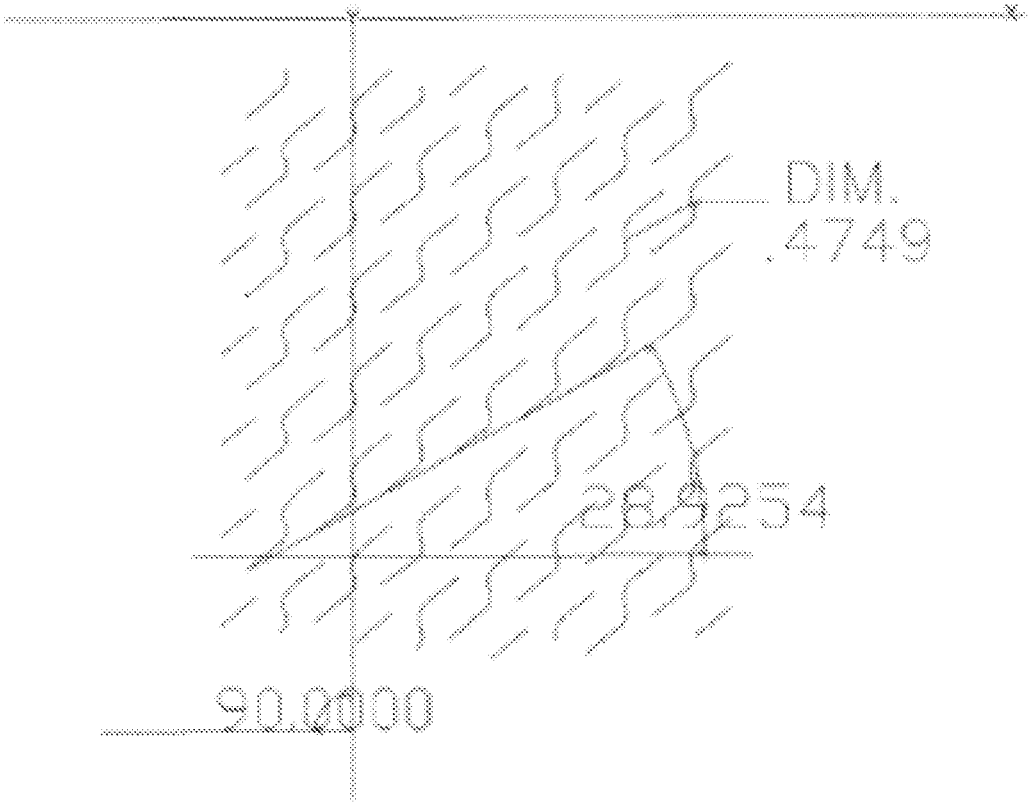

FIG. 14 illustrates how the web material appears when deployed. FIG. 14A is a plan view of the expanded webbing. Note the horizontal members and the vertical cross members. The cross members are twisted at their intersections with the horizontal members, thereby forming a three-dimensional structure. FIG. 14B is an edge view of the expanded webbing. Here the three-dimensional nature of the lattice structure is apparent. FIG. 14A shows the lattice voids as squares. They may also be rhombuses.

FIG. 15 shows dimensions of the variable parameters discussed supra for an exemplary embodiment. Refer to FIG. 15A. For this embodiment, the length of a tilde-slit, end-to-end, is 0.7072-inches. The length of each straight cut is 0.2665-inch, and the horizontal projected distance of the central portion is 0.1742-inches. FIG. 15B shows the total width of a tilde-slit to be 0.2991-inches, and the angle traversed by the central portion with the vertical Y-axis is 21.5236°. FIG. 15C shows dimensions of a tilde-slit cut at an angle to the horizontal. FIG. 15D shows dimensions of multiple adjacent rows of tilde-slits. FIG. 15E shows dimensions of a single tilde-slit. FIG. 15F shows dimensions of a single tilde-slit. FIG. 15G shows dimensions of two adjacent rows of tilde-slits arranged along the longitudinal direction of the web material. FIG. 15H shows dimensions of two adjacent rows of tilde-slits arranged at an angle to the longitudinal direction of the web material. FIG. 15I shows dimensions of multiple adjacent rows of tilde-slits arranged at an angle to the longitudinal direction of the web material.

Figure 16:
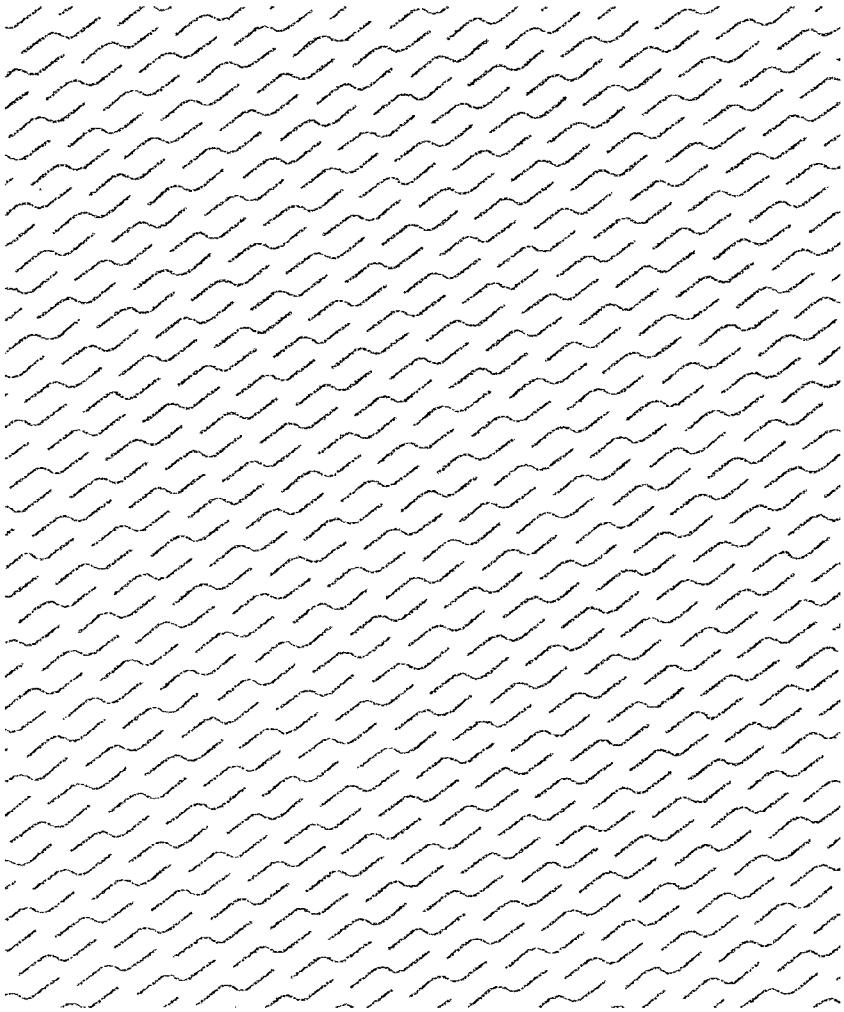
FIG. 16 illustrates a rectangular section of material with the rows of tilde-slits arranged at an angle to the longitudinal direction, the arrangement causing the slits to extend to the full width of the web.
Figure 17:
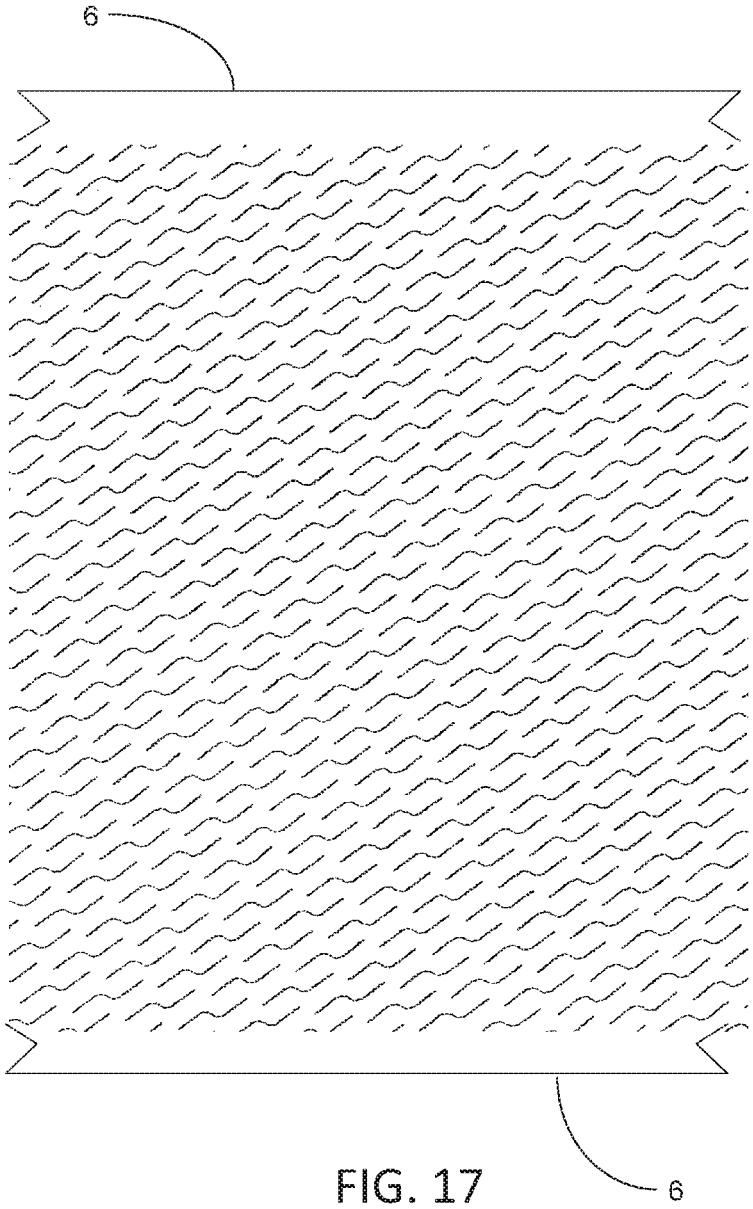
FIG. 17 illustrates a rectangular section of material with the rows of tilde-slits arranged at an angle to the longitudinal direction, the arrangement being such that two borders (devoid of slits) run parallel to the longitudinal direction and are positioned on both sides of the width of the web.

FIG. 16 illustrates a portion of the web material showing the rows of tilde-slits configured at an angle to the longitudinal axis. FIG. 17 illustrates the same thing. The difference between the two drawings is that in FIG. 16, the tilde-slit cuts extend to the ends of the web material in the width direction. In FIG. 17, two "rails," 6, which are devoid of slits, run parallel to the longitudinal direction and are situated at the ends of the web material in the width direction. For the embodiment in FIG. 17, the two rails extend for the entire roll. The function of the rails is to make deployment by users easier. However, both configurations (i.e., of FIGS. 9 and 10) work equally well.

The subject envelope is composed with a tilde matrix as a center expanded core filler between two sheets of paper or other suitable materials. Either a curvilinear or straight tilda matrix core can be used with any conventional style envelope constructions starting with the outer layer of the envelope having an expanded tilda matrix core attached thereto produces a middle expanded layer topped with an additional inner layer of paper becomes the inside surface of the paper envelope.

Figure 18A:
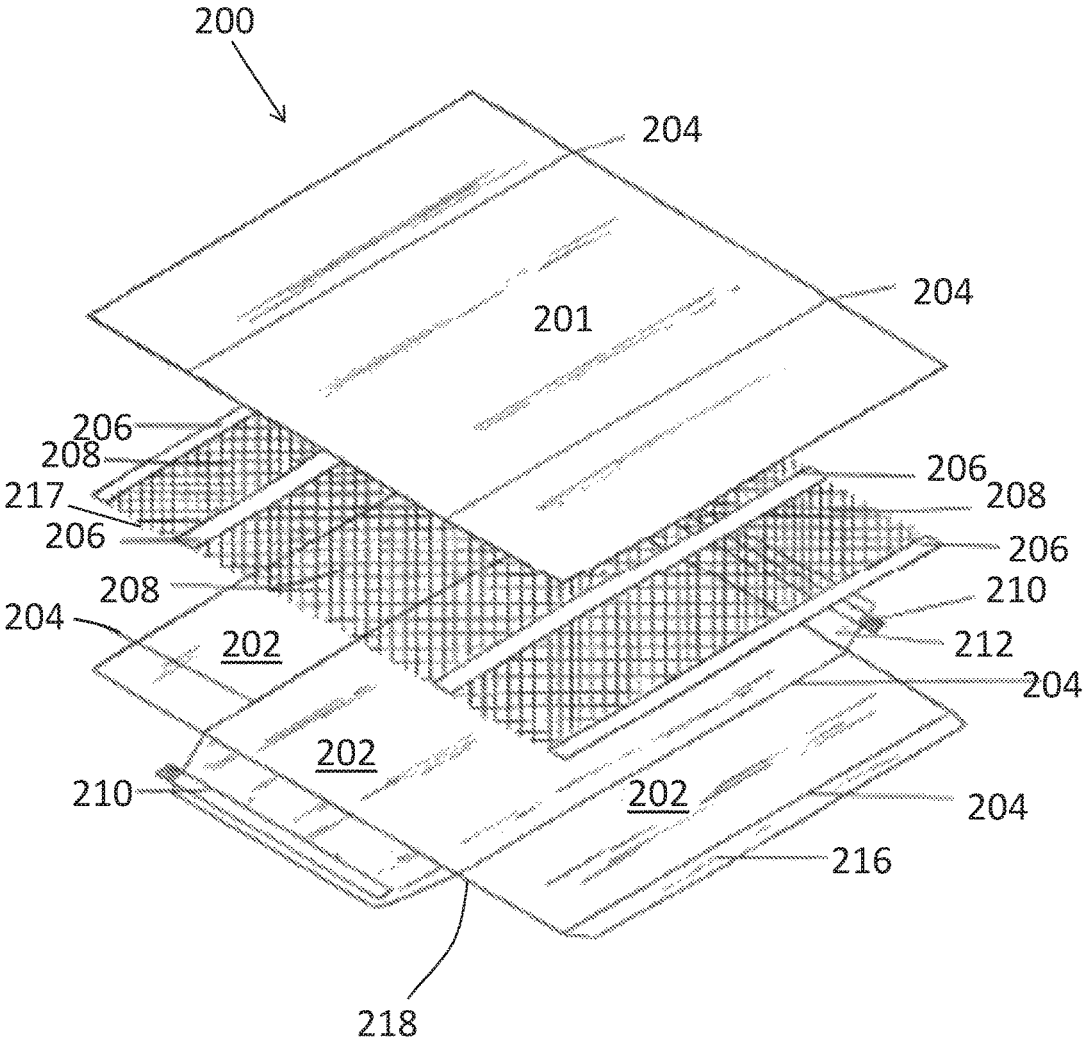
FIG. 18A shows an exploded view for a padded envelope construction having three (3) layers.
Figure 18B:
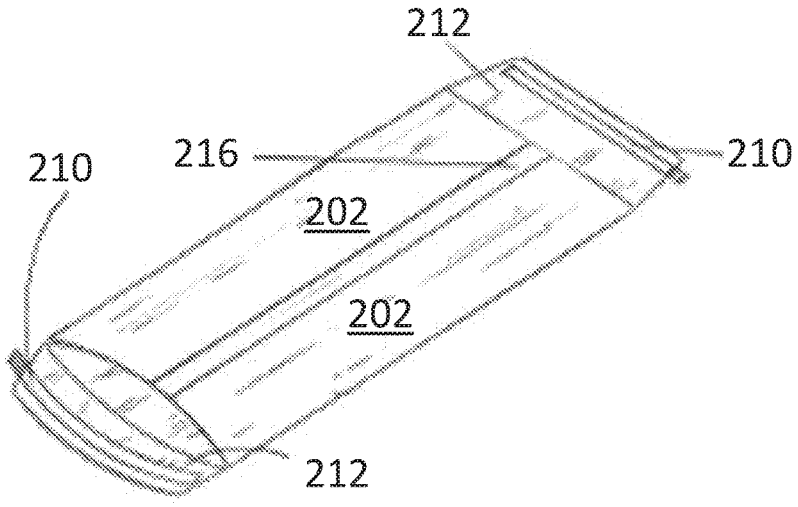
FIG. 18B shows assembly of the envelopes shown in FIG. 18A.
Figure 18C:
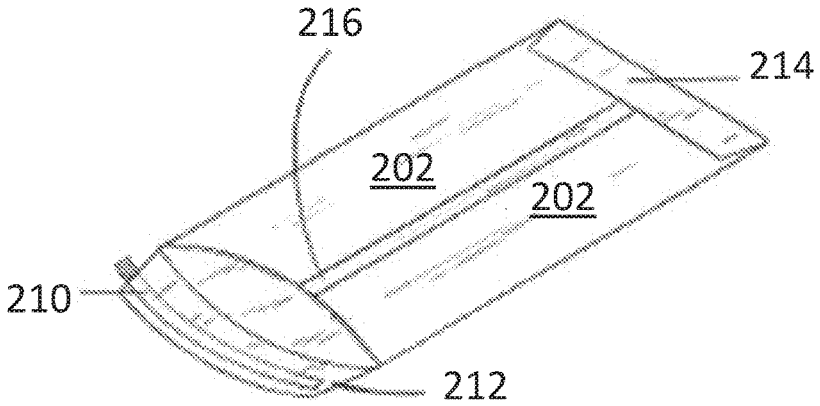
FIG. 18C shows assembly of the envelopes shown in FIG. 18A.

FIGS. 18A-18C illustrate an embodiment of the subject envelope. FIG. 18A shows an exploded view for a padded envelope construction having three (3) layers, shown generally at 200. FIG. 18B shows assembly of the envelopes shown in FIG. 18A. FIG. 18C shows assembly of the envelopes shown in FIG. 18A. Envelope 200 has a curvilinear or straight tilda matrix core 208 which can be used with any conventional style envelope constructions. Envelope 200 has an outer layer 202 with the expanded tilda matrix core 208 attached thereto to produce a middle expanded layer. Core 208 is topped with an additional inner layer 201 of paper, that becomes the inside surface of the paper envelope when it is assembled.

The envelope includes perimeter edges 218 and is constructed having offsets and creases 204 for clearance and for bend reductions for its folds, enabling the thicker layered construction to be folded over itself prior to its gluing or taping into its final thicker padded construction. Thus, a durable padded envelope 200 or sleeve assembly is formed of basically unlimited construction styles, shapes, sizes or types. The envelope 200 may include conventional tear strips, and can also have open or factory closed sleeve construction demonstrated herein, having flaps 213 (See FIG. 23, for example).

Sleeve construction are formed having open ends, or one open end, with or without a closure flap 212 at its opposite side, that are also easily produced for placement into standard sized or custom sized, or custom shaped envelopes enabling use with standard envelopes. When implemented, by simple insertion of said sleeve assembly into a properly matched and sized envelope the result is a padded envelope construction. A two layered sleeve having a smooth interior surface and outer expanded tilda web exterior is attached to its inner surface by its opposing rails and is stretched out between its rails and secured by light gluing or tape or other means. An expanded tilda matrix made this way using a two layer construction is less bulky. Thus when slipped into a common envelope enables in effect the padded envelope construction described. An optional attached closure flap 212 may be provided secured by hook and loop fasteners, such as Velcro®, snap, button, draw string or double stick tape seal 210, etc.

Two effective sleeve type envelope constructions are shown having two or three or more alternating layers of tilda matrix core 208 typically used with inner layer 201, or outer layers 202, demonstrating methods for envelope, envelope bag and sleeve constructions applicable to any size envelope or envelope bag requirements. Insert-able sleeves may be provided to fit within conventional envelopes, or as envelopes as entities unto themselves. The envelope may also be internally partitioned, and have living hinges 235. Thus padded envelope constructions, and insert-able sleeves used with standard envelopes are demonstrated herein having folded and taped or glued outer edges 220 typically with over lapping seamed joint 216 with a center expanded tilda matrix core 208 stretched open. Matrix perimeter borders 217 are attached to rails and expanded edges are located between generally parallel linear rails 206 that hold and stay the rails of the opened expanded tilda matrix core 208 prior to it being fixed in place using laminated joints, glue or tape, or any conventional means of construction relative to the material or materials used for said constructions. Reactive or non-reactive adhesives and fixatives may be used to assemble and construct the envelope or sleeve assembly. A raised pattern 203 is created, typically at inner 201 and outer layer 202. The above configurations also apply to envelope bag construction as demonstrated hereinafter.

Envelope 200 includes outer layer 202, inner layer 201, perimeter edges 218, creases 204. Factory closed sleeves 214 are constructed having flaps 213 with folded and taped or glued outer edges 220 and over lapping seamed joints 216. Matrix perimeter borders 217 are provided secured with rails 206 and holds and stays 226. A raised pattern may be provided with about 180° folded rails with a corner seamed rail (See FIG. 23 for raised pattern 603 provided with 90° folded rails 627). Envelopes and sleeves can have Mylar foil or any other protective coating used to stop RF, or can be used as insulated bags for hot or cold applications, other applications as needed or required per an application. The bags or sleeves can also be made from non-permeable web materials such as plastics or thin expanded foam materials from corn or soybean based plastic, may also be used and be co-combined for the central tilda matrix core 208, or used for other outer uncut surfaces for said envelopes, sleeve or bag constructions for the interior or outer sections of said envelope, envelope bag or sleeves from generally flexible less permeable materials. The preferred materials are typically bio degradable, therefore causing no harmful accumulated pollution. The subject bags, sleeves or envelopes can also be manufactured from non-permeable or semi permeable materials such as Tyvek®. The subject gags, sleeves or envelopes can also be a useful adjunct to the medical field, constructed using heat sealing, frequency welding or any conventional joining practices applicable to their constructions.

The subject invention can all be applied to any envelope or bag construction. A folding envelope bag is described herein in regards to FIG. 2325C. The subject envelope, envelope sleeve includes with inner layer 201, and outer layer 202, and an optional attached closure flap 212 secured by hook and loop fasteners, such as Velcro®, snap, button, draw string or double stick tape seal 210, etc. Handles may be provided with water activated adhesive seal 224, or a single, or 210 double stick tape seal 210, or any applicable sealing method capable of resealing typically being air tight may be used. The envelope, bag or sleeve may be constructed with or without coatings on the interior or exterior of the bag, or to both interior and exterior surfaces of the envelope or bag envelope. Also, the subject bag or envelope can be used for hot, or cold thermal applications as needed for the bag contents. The envelope, bag or sleeve may be ventilated. Both envelopes and bags can be made partitioned 236 using living hinges 235 constructed with gaps or gap 337. A conventional generally flat folding bag having fold lines 230 and seams 232 is depicted shown opened, having an inner wall 200 and outer wall 202, depicted by cutaway section view, shown at 234 is tilda Matrix core 208.

These bags are typically or primarily made from paper stock, and would be useful for microwave or other cooking, thus keeping the food contents hot for an extended period of time, making them a convenient format for use in the restaurant or fast food businesses, thus providing the customer or end users an inexpensive and practical convenience, keeping their food hot and fresh for a longer period of time prior to its consumption. This advantageous format for padded envelope construction using paper is lighter compared to all paper padded cushioned type envelopes having a macerated paper inner-fill making them suitable for airmail, or any shipping requiring a light weight construction saving fuel and material; and are eco-friendly; especially when made from bio degradable material.

Figure 19A:
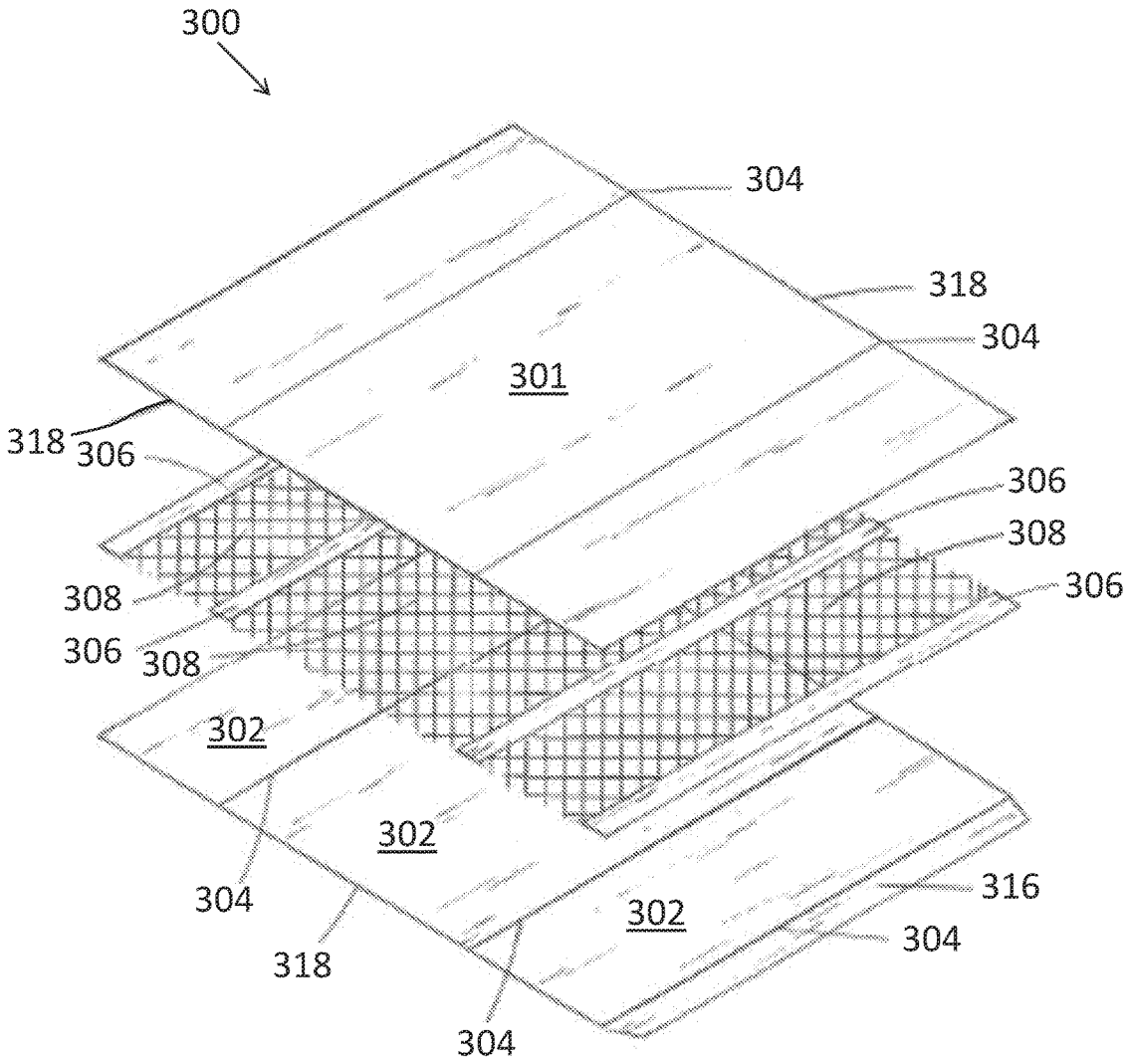
FIG. 19A shows an exploded for a padded envelope sleeve construction having three (3) layers.
Figure 19B:
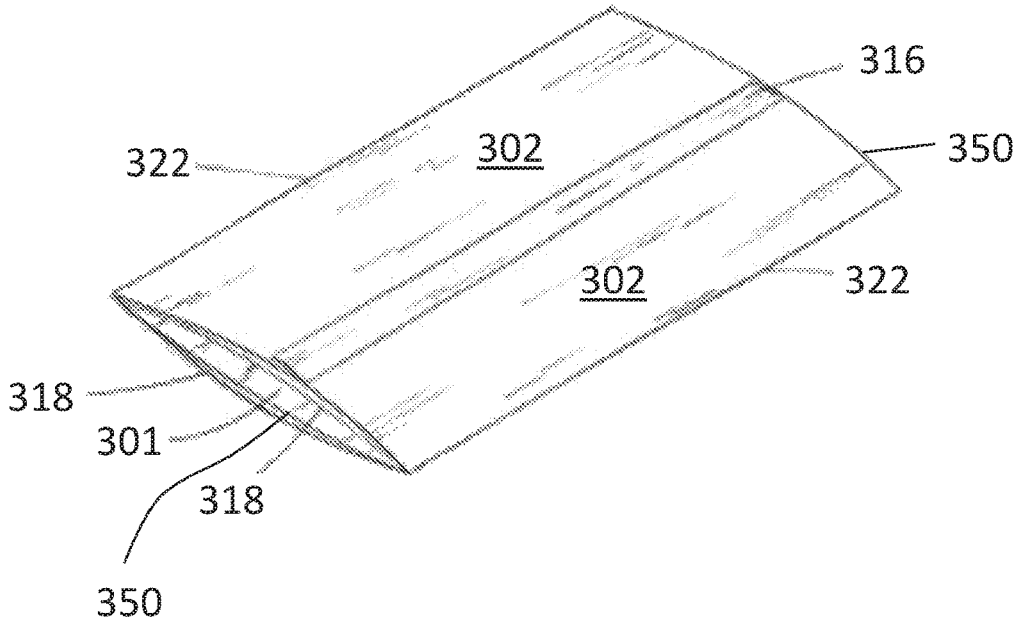
FIG. 19B shows the folded and assembled envelope sleeve.

FIG. 19A shows an exploded for a padded envelope sleeve construction having three (3) layers, shown generally at 300. FIG. 19B shows the folded and assembled envelope sleeve. Sleeve 300 includes outer layer 302, inner layer 301, perimeter edges 318, and creases 304 for folding. The formed envelope or sleeve shown in FIG. 19B has open ends 350. Matrix perimeter borders are provided secured with rails 306 and holds and stays. A raised pattern is provided with 90° folded rails with a corner seamed rail. The padded envelope or insert-able sleeve for use with standard envelopes has folded and taped or glued outer edges typically with over lapping seamed joint 316 with a center expanded tilda matrix core 208 stretched open.

Figure 20:
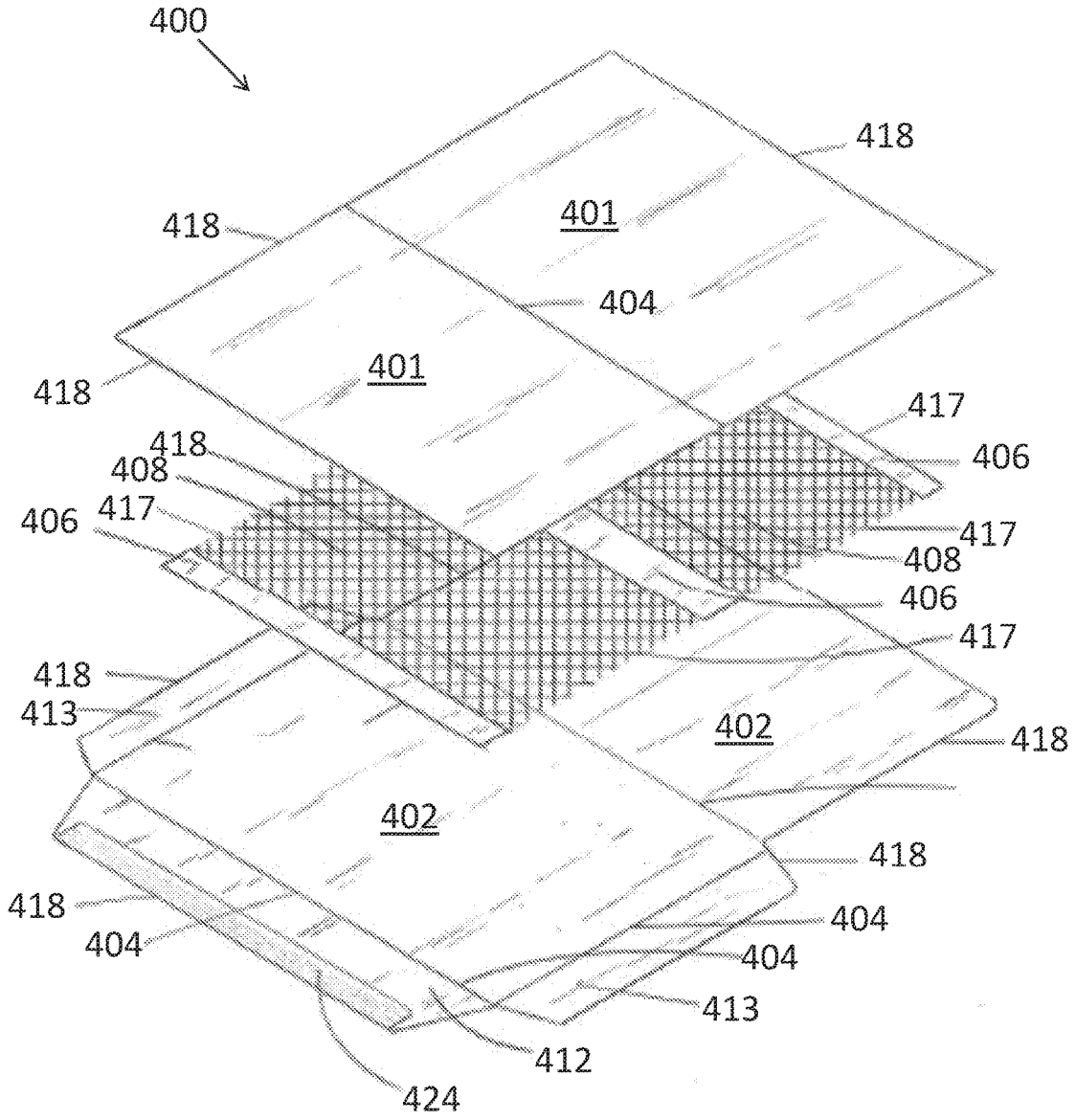
FIG. 20 shows an exploded view for a padded envelope having three (3) layers when folded and assembled to produce the envelope shown in FIG. 24 showing internal tilda Matrix core and layering of three (3) layers.
Figure 21:
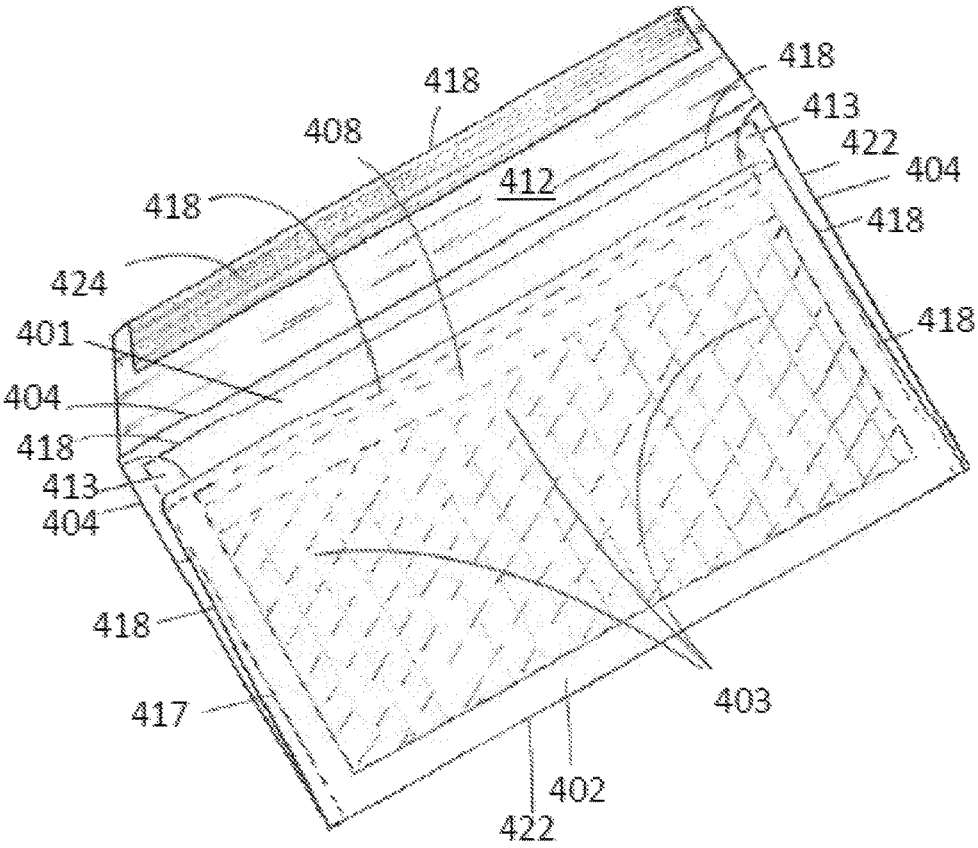
FIG. 21 shows a top plane view of the padded envelope having three (3) layers when folded and assembled.
Figure 23:
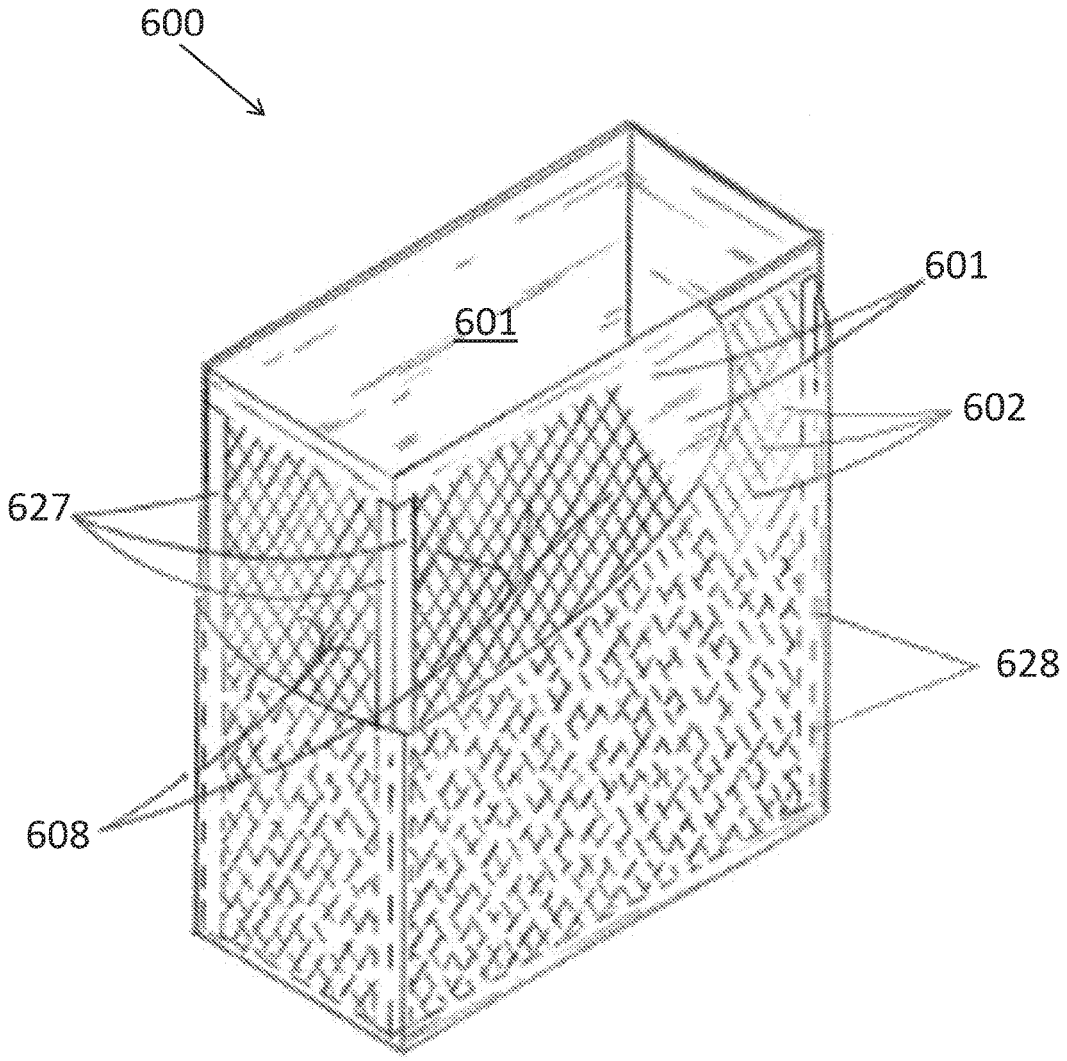
FIG. 23 shows a five (5) sided envelope padded bag construction revealing a three (3) layer format having an inner, outer, and center layer tilda Matrix core revealing its basic construction and general appearance without further details.
Figure 24:
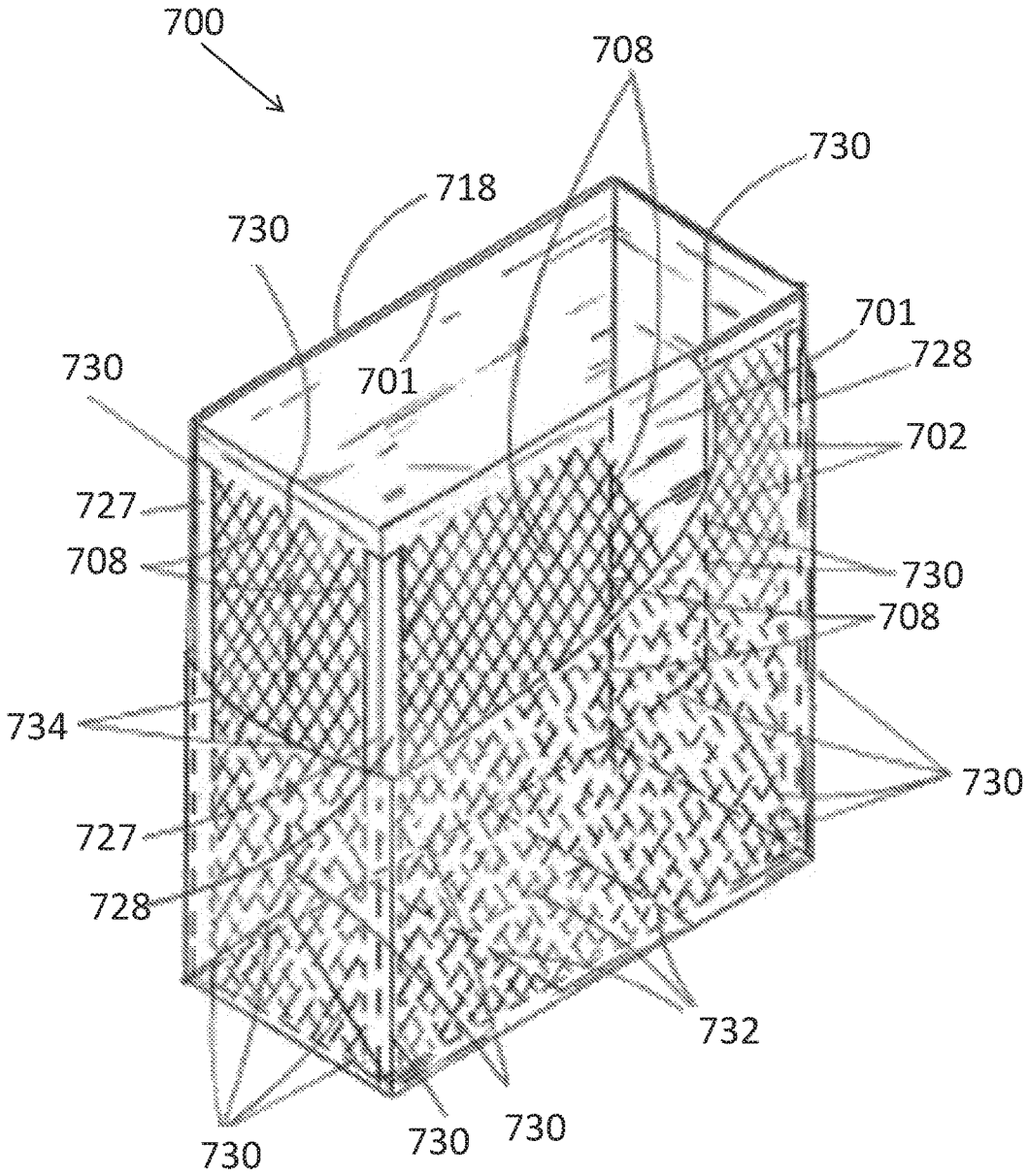
FIG. 24 shows a five (5) sided envelope padded bag construction revealing a three (3) layer format having an inner, outer, and center layer tilda Matrix core revealing its basic construction and general appearance having fold lines to allow the assembled envelope bag to fold basically flat for storage prior to or after use.

FIG. 20 shows an exploded view for a padded envelope having three (3) layers when folded and assembled to produce the envelope shown in FIG. 24 showing internal tilda matrix core, shown generally at 400. FIG. 21 shows a top plane view of the padded envelope having three (3) layers when folded and assembled. Referring to FIGS. 23 and 24, envelope 400 includes outer layer 402, inner layer 401, perimeter edges 418, and creases 404 for folding. Matrix perimeter borders of tilda matrix core 408 are secured with rails 406 and holds and stays. A raised pattern 403 may be provided about 180° folded rails with a corner seamed rail (See FIG. 23 for raised pattern 603 provided with 90° folded rails 627). Matrix perimeter borders 417 are attached to rails and expanded edges are located between the generally parallel linear rails 406 that hold and stay the rails of the opened expanded tilda matrix core 408 prior to it being fixed in place using laminated joints, glue or tape, or any conventional means of construction relative to the material or materials used for said constructions. Reactive or non-reactive adhesives and fixatives may be used to assemble and construct the envelope or sleeve assembly. A closure flap 412 is provided with a corner seamed rail secured with water activated adhesive seal 424, or the like. As shown in FIG. 21, the envelope is formed folded at 422.

Figure 22:
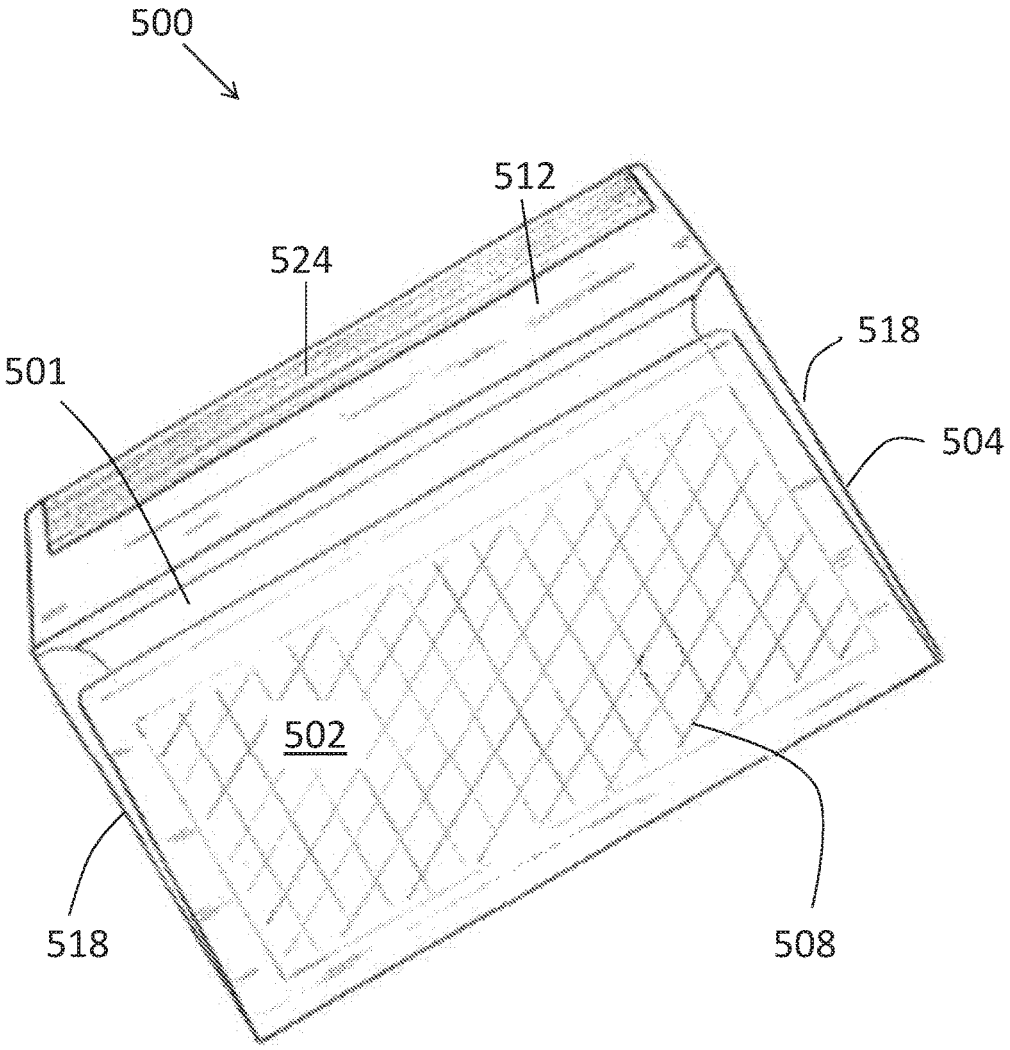
FIG. 22 shows a top plane view of the padded envelope having three (3) layers when folded and assembled.

FIG. 22 shows a top plane view of the padded envelope having three (3) layers when folded and assembled, shown generally at 500. Envelope 500 includes outer layer 502, inner layer 501, perimeter edges 518, creases 504, and tilda matrix core 508. Reactive or non-reactive adhesives and fixatives may be used to assemble and construct the envelope or sleeve assembly. A closure flap 512 is provided with water activated adhesive seal 524, or the like.

FIG. 23 shows a five (5) sided envelope padded bag construction revealing a three (3) layer format having an inner, outer, and center layer tilda Matrix core revealing its basic construction and general appearance without further details, shown generally at 600. Envelope padded bag 600 includes outer layer 602, inner layer 601, and tilda matrix core 608. A raised pattern 603 is provided with 90° folded rails 627 with a corner seamed rail 628.

FIG. 24 shows the same basic view of FIG. 23 revealing additional detail for the padded envelope bag construction having fold lines 730 to allow the assembled envelope bag to fold basically flat for storage prior to or after use, shown generally at 700. Envelope bag 700 includes outer layer 702, inner layer 701, perimeter edges 718, and tilda matrix core 708. Living hinges 734 are provided. A raised pattern is provided with 90° folded rails 727 with a corner seamed rail 728. Double stick tape seal is provided at fold lines 730 and seams 732 of the tilde matrix core 708.

Figure 25A:
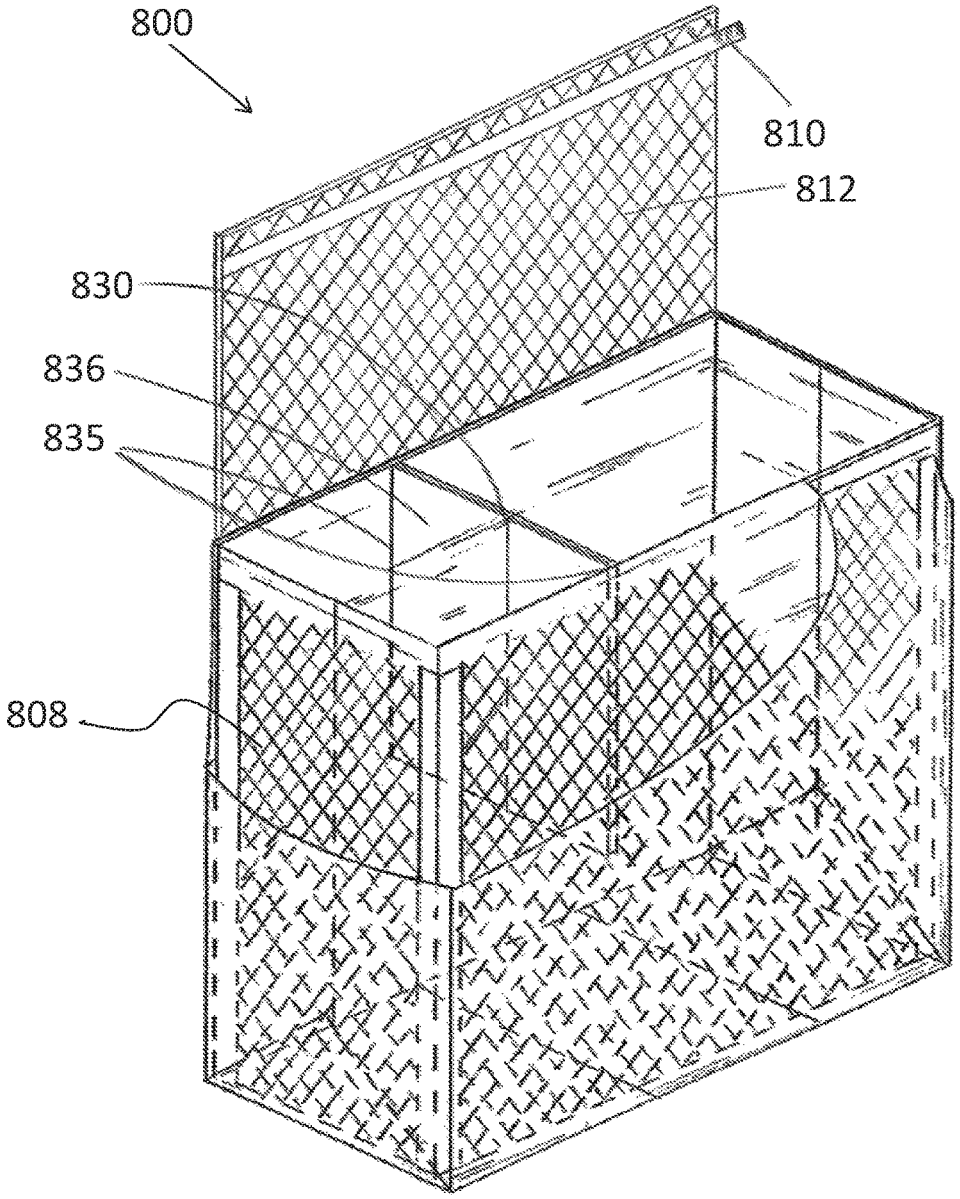
FIG. 25A shows a five (5) sided envelope padded bag construction revealing a three (3) layer format having an inner, outer, and center layer tilda Matrix core revealing its basic construction and general appearance without further details.
Figure 25B:
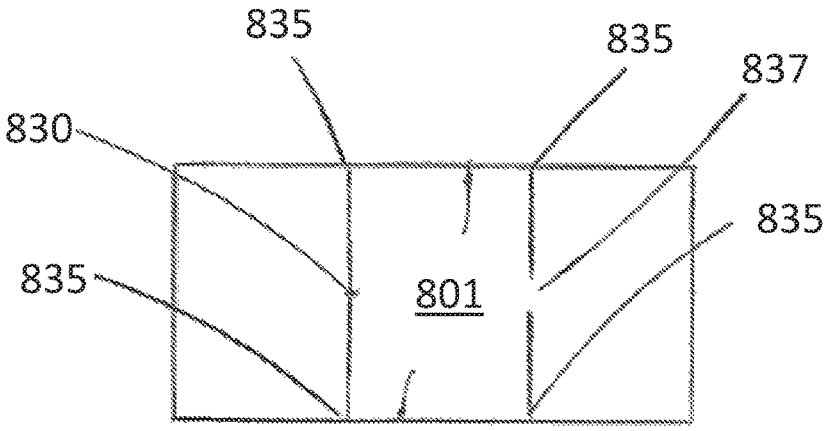
FIG. 25B shows a top view of the use of hinges with clearance gap enabling flat folding.
Figure 25C:
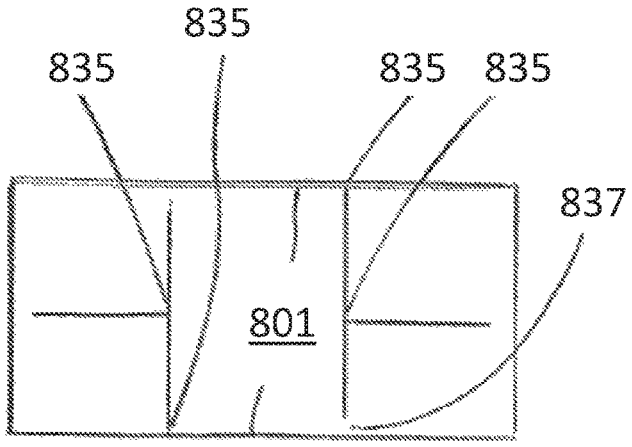
FIG. 25C shows a top view of the use of hinges with clearance gap enabling flat folding.
Figure 28A:
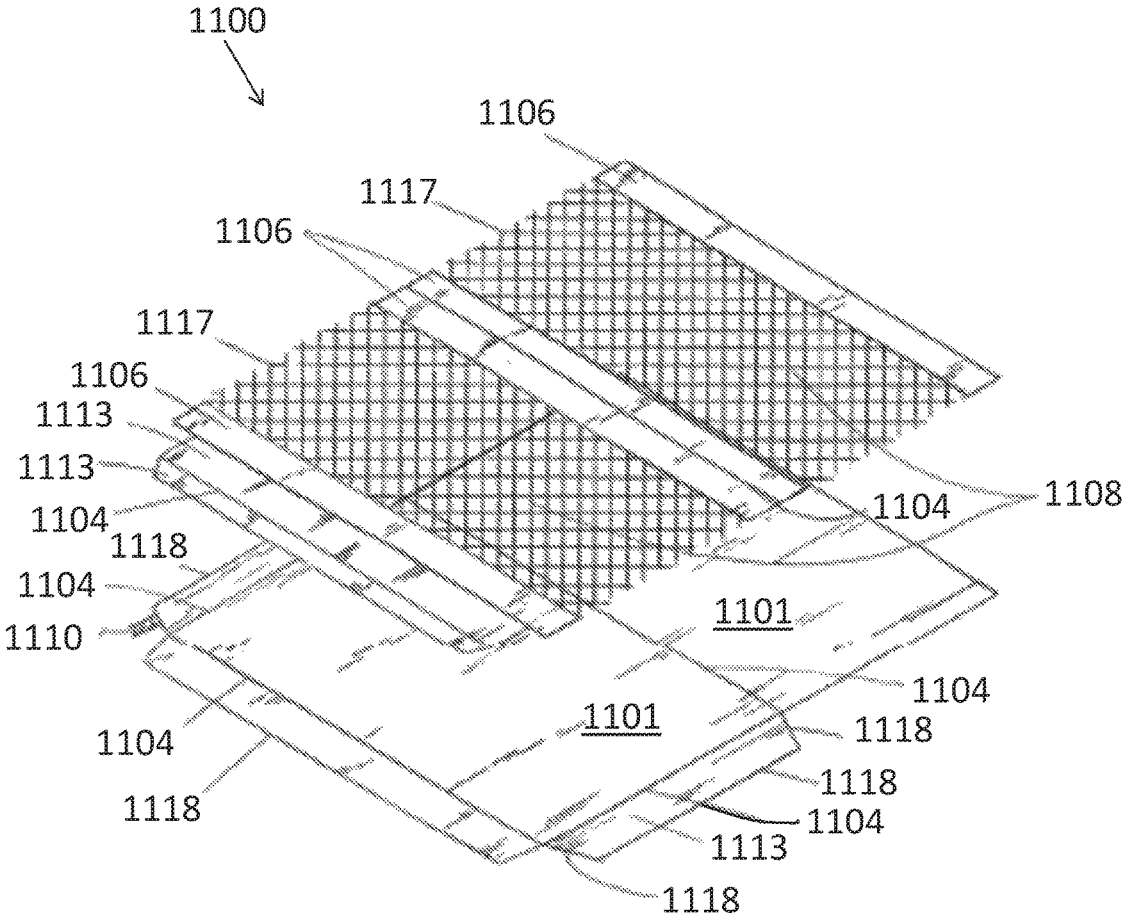
FIG. 28A shows an exploded view of an envelope padded sleeve construction having an inner layer and outer layer tilda Matrix core attached to it having a factory closed sleeve construction at its end to it, with a closed flap typically secured with a double stick tape seal.
Figure 28B:
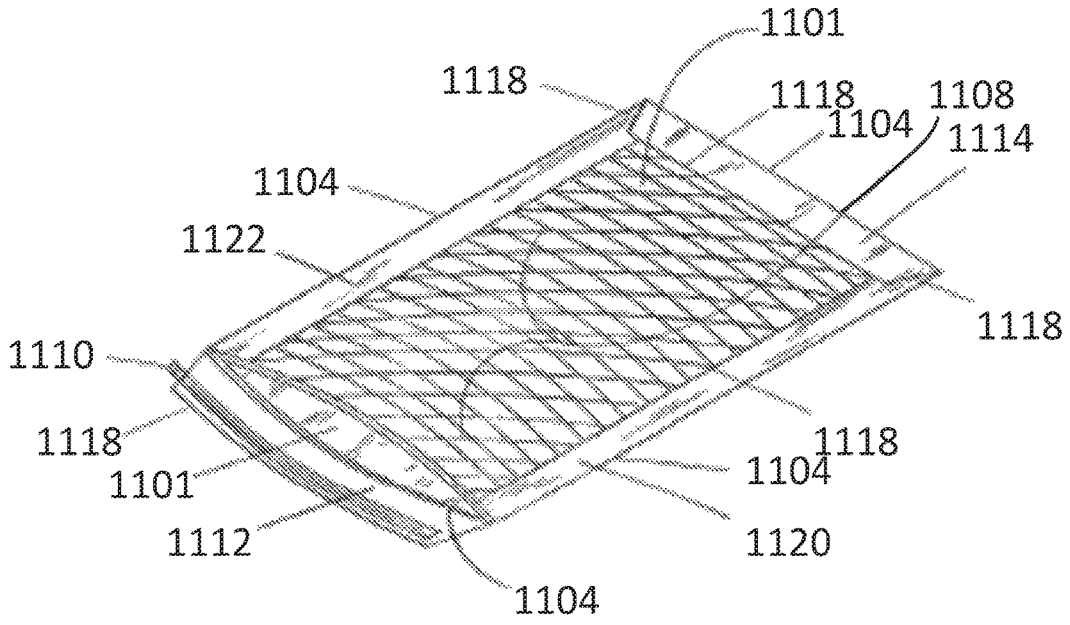
FIG. 28B shows a perspective view of an the envelope padded sleeve construction fully assembled and ready for use.

FIG. 25A shows a five (5) sided envelope padded bag construction revealing a three (3) layer format having an inner, outer, and center layer tilda Matrix core revealing its basic construction and general appearance without further details, shown generally at 800. FIG. 25B shows a top view of the use of hinges with clearance gap enabling flat folding. FIG. 25C shows a top view of the use of hinges with clearance gap enabling flat folding. FIG. 25 is the same basic view of FIG. 26 shows closure flap 812 and tape seal 810; with built in partition wall 836 having living hinges are provided having hinge partition 835 with gaps or gap 837 and creased fold line 830 enable padded envelope bag construction to fold flat for storage prior to or after use. This construction is shown having one partition; more than one partition are also possible. FIGS. 28A and 28B show top views of the use of living hinges with clearance gap enable flat folding of said envelope bag creating four or more basically demised sectional areas. Closure flap 812 is provided with a corner seamed rail secured with water activated adhesive seal, or the like. Double stick tape seal 810 is provided at fold lines 830 and seams of the tilde matrix core 808.

Figure 26A:
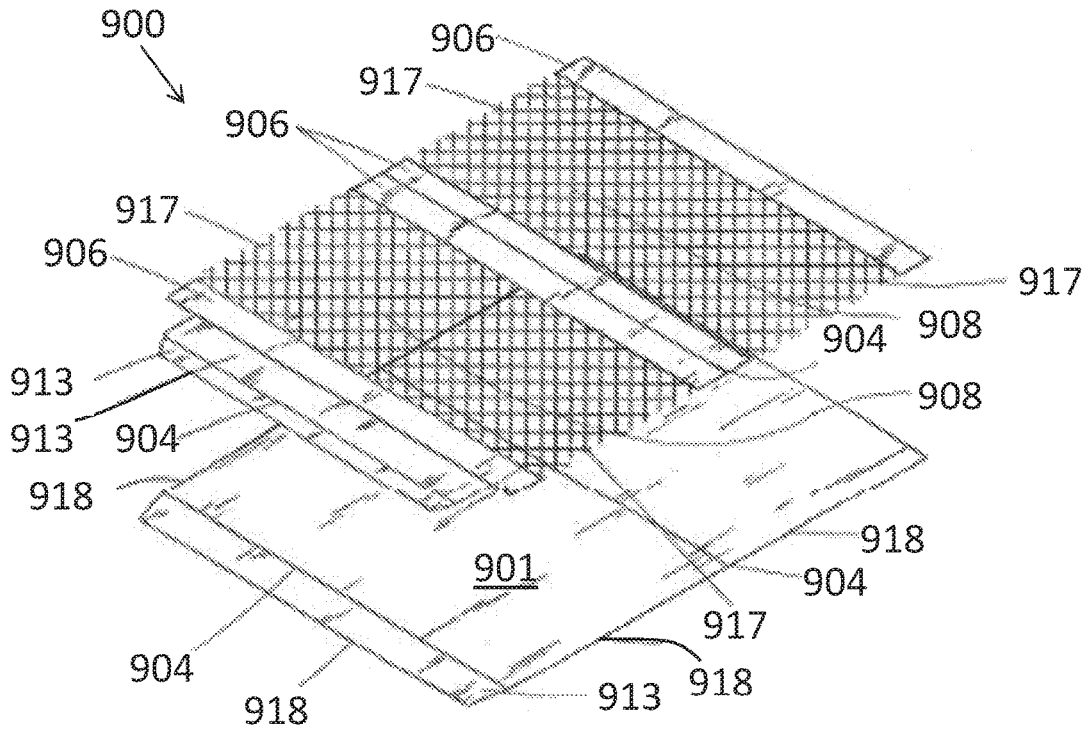
FIG. 26A shows an envelope padded sleeve construction made from an inner layer and outer layer tilda Matrix core attached to it, used for padding a standard envelope or other use for padded storage or handling.
Figure 26B:
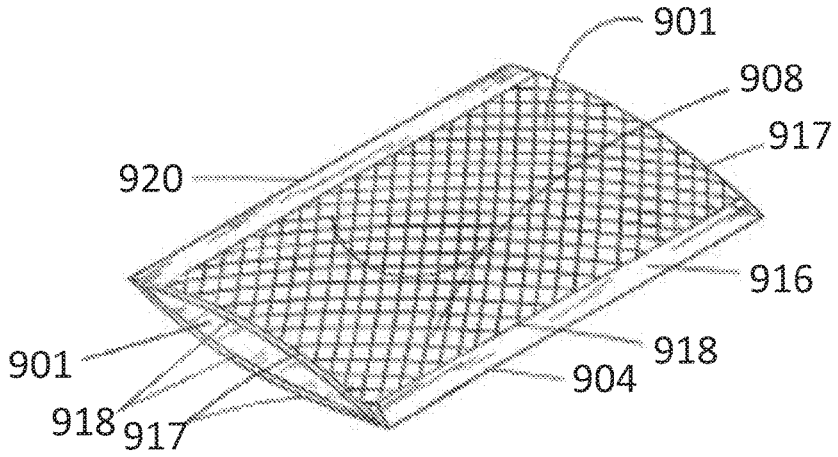
FIG. 26B is a perspective view demonstrated as a finished construction.

FIG. 26 shows an envelope padded sleeve construction made from an inner layer and outer layer tilda Matrix core attached to it, used for padding a standard envelope or other use for padded storage or handling. FIG. 26A is a perspective view demonstrated as a finished construction, shown generally at 900. FIG. 26B is a perspective view demonstrated as a finished construction. Envelope 900 includes inner layer 901, perimeter edges 918, and creases 904 for folding. Matrix perimeter borders of tilda matrix core 908 are secured with rails 906 and holds and stays. Matrix perimeter borders 917 are attached to rails and expanded edges are located between the generally parallel linear rails 906 that hold and stay the rails of the opened expanded tilda matrix core 908 prior to it being fixed in place using laminated joints, glue or tape, or any conventional means of construction relative to the material or materials used for said constructions. Reactive or non-reactive adhesives and fixatives may be used to assemble and construct the envelope or sleeve assembly. The envelope 900 may include conventional tear strips, and can also have open or factory closed sleeve construction demonstrated herein, having flaps 913. The construct includes folded and taped or glued outer edges 920 typically with over lapping seamed joint 916 with a center expanded tilda matrix core 908 stretched open.

Figure 27A:
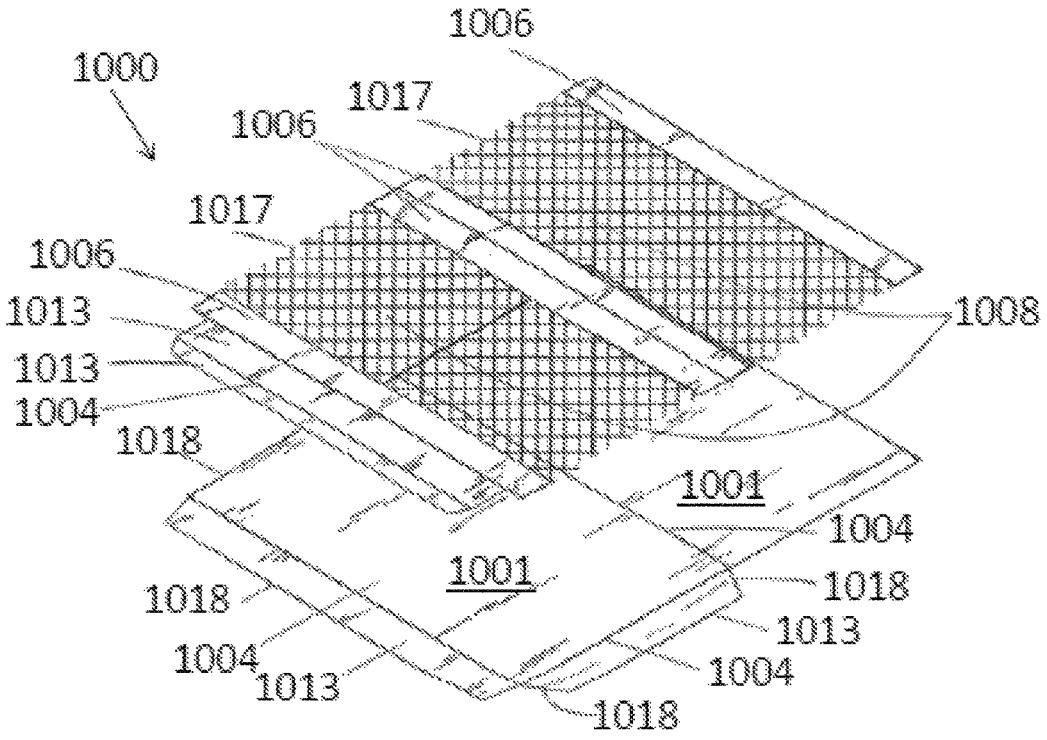
FIG. 27A shows an exploded view envelope padded sleeve construction made from an inner layer and outer layer tilda Matrix core attached to it, having a factory closed sleeve construction at it end to close it.
Figure 27B:
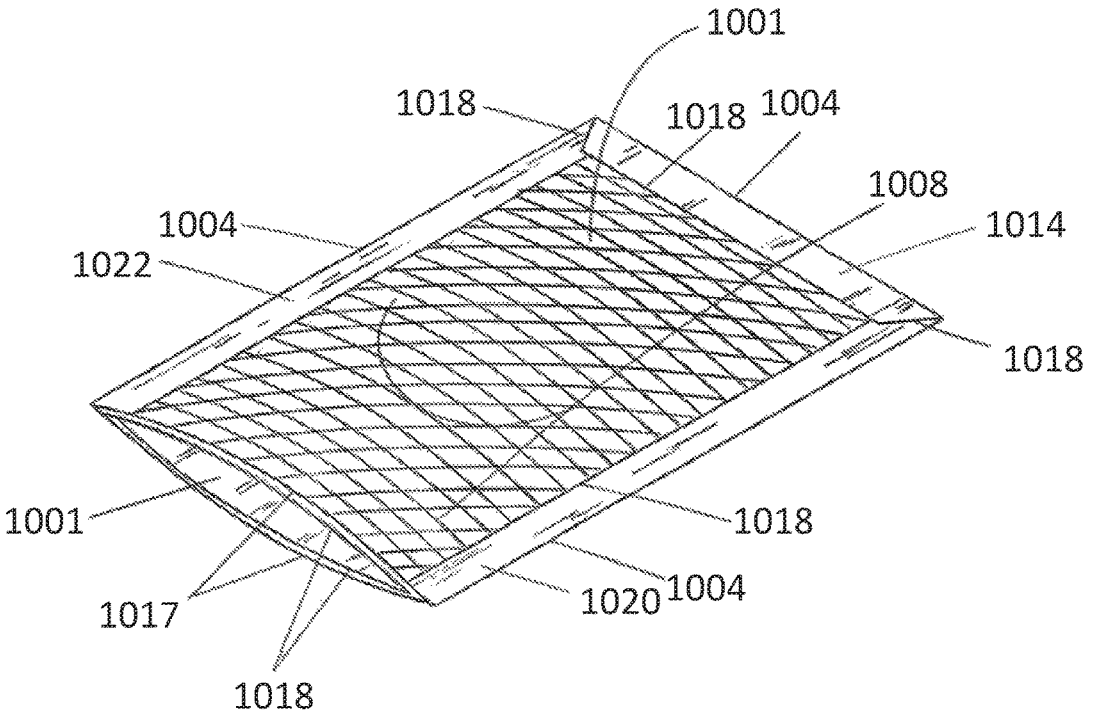
FIG. 27B shows a perspective view of an assembled completed padded envelope sleeve construction having factory closed sleeve construction at one end.

FIG. 27A shows an exploded view envelope padded sleeve construction made from an inner layer and outer layer tilda Matrix core attached to it, having a factory closed sleeve construction at it end to close it, shown generally at 1000. FIG. 27B shows a perspective view of an assembled completed padded envelope sleeve construction having factory closed sleeve construction at one end. Envelope padded sleeve 1000 includes inner layer 1001, perimeter edges 1018, and creases 1004 for folding. Matrix perimeter borders of tilda matrix core 1008 are secured with rails 1006 and holds and stays. Matrix perimeter borders 1017 are attached to rails and expanded edges are located between the generally parallel linear rails 1006 that hold and stay the rails of the opened expanded tilda matrix core 1008 prior to it being fixed in place using laminated joints, glue or tape, or any conventional means of construction relative to the material or materials used for said constructions. Reactive or non-reactive adhesives and fixatives may be used to assemble and construct the Envelope padded sleeve or sleeve assembly. The Envelope padded sleeve 1000 may include conventional tear strips, and can also have open or factory closed sleeve construction demonstrated herein, having flaps 1013. The construct includes folded and taped or glued outer edges 1020 typically with over lapping seamed joint 1016 with a center expanded tilda matrix core 1008 stretched open. Factory closed sleeve construction 1014 is thereby provided having folded and taped or glued outer edges 1020 typically with over lapping seamed joint with a center expanded tilda matrix core 1008 stretched open. The envelope is formed folded at 1022.

FIG. 28A shows an exploded view of an envelope padded sleeve construction having an inner layer and outer layer tilda Matrix core attached to it having a factory closed sleeve construction at its end to it, with a closed flap typically secured with a double stick tape seal, shown generally at 1100. FIG. 28B shows a perspective view of an the envelope padded sleeve construction fully assembled and ready for use. Envelope padded sleeve 1100 includes inner layer 1101, perimeter edges 1118, and creases 1104 for folding. Matrix perimeter borders of tilda matrix core 1108 are secured with rails 1106 and holds and stays. Matrix perimeter borders 1117 are attached to rails and expanded edges are located between the generally parallel linear rails 1106 that hold and stay the rails of the opened expanded tilda matrix core 1108 prior to it being fixed in place using laminated joints, glue or tape, or any conventional means of construction relative to the material or materials used for said constructions. Reactive or non-reactive adhesives and fixatives may be used to assemble and construct the Envelope padded sleeve or sleeve assembly. The Envelope padded sleeve 1100 may include conventional tear strips, and can also have open or factory closed sleeve construction demonstrated herein, having flaps 1113. The construct includes folded and taped or glued outer edges 1120 typically with over lapping seamed joint 1116 with a center expanded tilda matrix core 1108 stretched open. Factory closed sleeve construction 1114 is thereby provided having folded and taped or glued outer edges 1120 typically with over lapping seamed joint with a center expanded tilda matrix core 1108 stretched open. The envelope is formed folded at 1122. An optional attached closure may be provided secured by hook and loop fasteners, such as Velcro®, snap, button, draw string or double stick tape seal 1110, etc. The Envelope padded sleeve 1100 may include conventional tear strips, and can also have open or factory closed sleeve construction demonstrated herein, having flaps 1113. The construct includes folded and taped or glued outer edges 1120 typically with over lapping seamed joint 1116 with a center expanded tilda matrix core 1108 stretched open. Factory closed sleeve construction 1114 is thereby provided having folded and taped or glued outer edges 1120 typically with over lapping seamed joint with a center expanded tilda matrix core 1108 stretched open. The envelope is formed folded at 1122.

Figure 1:
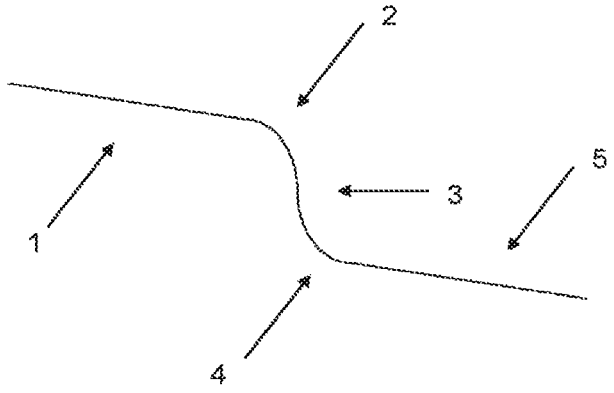
FIG. 1 illustrates the shape of a tilde-slit.
Figure 2:
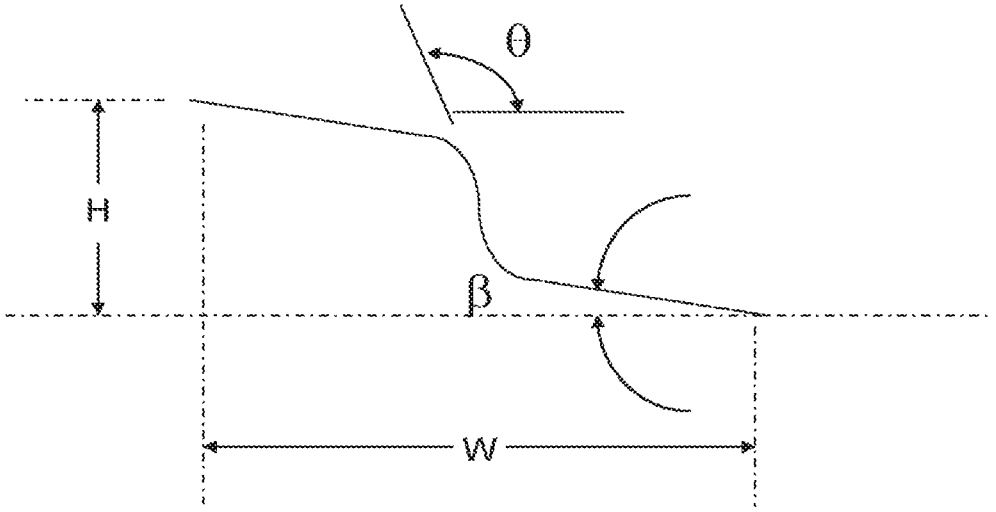
FIG. 2 illustrates variable parameters that determine the shape of the tilde-slit.

The basic shape of the tilde-slit can vary, and is dependent upon the angle θ (see FIG. 10 for example). That angle should be obtuse (i.e., >90°). A "Z" shaped cut tends to tear, and it does not allow for easy opening or expansion. While the curved sections 2 and 4 of FIG. 1 are not strictly necessary, rounded corners are preferred because such a cut provides a stronger structure when deployed. When used as a packing material, the use of rounded corners allow the subsequent folded sections of the lattice structure to fold more easily when the webbing is wrapped around an object.

The cross members form protrusions when the web material is expanded. Because of the three-dimensional nature of the web material, and the way that the material with these cuts expands, the resulting crushed material maintains a spring like elastic consistency. Randomly crushed material has a supporting characteristic, and it tends to be lightweight for its volume. The structure, when expanded and wrapped around an object tends to stay in place without tape or ties.

The cross member protrusions accomplish the following:

- Upon expansion, the protrusion is created having a fold line.
- This fold line stiffens the protrusion and each side of the resulting lattice cell structure.
- The protrusion is created on both sides of the web material, front and back, on opposite sides.
- Due to the spring like elasticity, the protrusion adds resiliency to each cell and the entire lattice.
- The protrusions help to allow the expanded web to nest or interlock cell to cell when wrapped around an object or itself. Some interlocking even occurs when the expanded structure is randomly crumpled upon itself.
- The protrusions add depth, volume, rigidity, and nesting capabilities to this structure when expanded and put to use.

The web can be made from almost any material having a high to low flexibility as long as it can be formed. Suitable materials include, inter alia, paper, cardboard, plastic film, resinous materials, fibrous materials, or metals. Any material than can be cut and allowed to displace into the resulting shape with a minimal spring back could be considered. Materials having spring back characteristics might be considered if the structure is held open using mechanical stays.

The basic structure of the expanded web material having a curvilinear structure described in the subject Application has the following useful functions:

- as breathable bandages having less skin contact and designed for application as needed;
- as knitted circular or flat printed or grown stents or mechanically connected circular stents for anatomical or surgical applications;
- as structures for some or part thereof in the manufacture of flat circular or tube like compression bandages;
- as a platform for the generation of anatomically printed body parts;
- in applications to generate surfaces to help control and inhibit microbial growth on said surfaces that are generally small or microscopic and having an irregularly broken pattern, especially useful in hospital setting to inhibit outbreaks of contagious disease;
- as padding in padded envelope construction (see FIGS. 6 and 7; discussion hereinabove) using a tilde matrix central core and relatively smooth outer surfaces to produce a tough padded material having flexibility with a degree of conformability;
- as insulation;
- as a cushioning or packing material;
- as an absorbent filler for liquid spills;
- as an expanded screen (hard or soft);
- as a filter;
- as a spacing element;

as a fire stop;
as a collating device;
as a crumple zone;
for heat transfer;
as a noise barrier;
as a net;
as a screen;
as a shade;
as a sieve;
as a mesh;
as an abrasive substrate;
as a soil stop for earth retention;
as a concrete or mason's cloth;
as a modeling armature;
for use with paper towel construction or mop device wipes producing catching voids for particle or dirt collection;
as produced using nano technology for potential unrealized or unexpected applications;
for use as an air separator between building siding and sheathing that allows for convective or forced air flow;
etc.

The tilde-slits must be carefully designed. If not, the material could be difficult to deploy. Possible results are:

The web will not expand.
The web will expand partially, not evenly, or will tear.
The web will expand with an uneven lattice pattern.
The web will expand with an uneven depth in the third dimension.
The force required to expand the web will vary along the length of the web.

Accordingly, the web material of the embodiment shown in FIG. 15, and disclosed supra, yields excellent results when expanded. The dimensions in this embodiment are scalable in that selection of parameter dimensions that produce a geometrically similar tilde-slit pattern would also yield excellent results when expanded. However, other patterns are possible. By varying the parameters, rectangular or parallelogram shaped voids may be created having different dimensions in the longitudinal direction than the width direction.

From our previous discussion of the embodiments of FIGS. 5, 6, 9, and 10, we discern that the outside rails that run longitudinally along the entire length of the web material are unnecessary. This is distinguished from the web material in the Fence Tape Patent where the rails are necessary to keep the fence from tearing apart when deployed. However, outside rails provide a grasping region that can be useful to help a user expand the web. The tilde-slit pattern can also be arranged so that, if desired, web expansion closer to the longitudinal centerline is greater than the expansion closer to the outside rails. This would allow a more controlled expansion of the web material. The result would be a distended center most section that is longer than at the ends. Here, the material would bow out to create a deeper three-dimensional structure.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An envelope construct comprising:

a. at least two sheet layers and a tilde matrix core placed there between;

b. said tilde matrix core comprising a web material having a longitudinal direction and dimension, a width direction and dimension, a top surface, a bottom surface, and at least two edges that are boundaries of the width dimension, said web material comprising a plurality of rows of tilde-slits.

2. The envelope construct of claim 1, wherein said web material comprises: a) the tilde-slits are cut extending from the top surface to the bottom surface; b) the tilde-slits are all congruent; c) each tilde-slit when unexpanded is a slit that consists essentially of: two essentially parallel end portions separated by a center portion transverse to the end portions; the center portion further comprising a center point; wherein when a tensile force is applied on the web material the tilde-slits expand to form voids within the web material; d) each row of tilde-slits comprising a plurality of tilde slits wherein their center points all lie along a straight centerline; e) the centerlines of the plurality of rows of tilde-slits are essentially parallel to each other; f) the end portions of the tilde-slits in a row are not parallel to the centerlines; g) the center point of any tilde-slit in a given row is positioned relative to the center point of the nearest tilde-slit in an adjacent row along a transversal intersecting the essentially parallel centerlines of the adjacent rows, wherein said transversal is not perpendicular to the essentially parallel centerlines; h) a second transversal extending coincident to said center point of an adjacent row and intersecting said transversal at an angle $\alpha$ to the longitudinal direction (x-axis), wherein the second transversal is not parallel to the longitudinal direction (x-axis) so that the tilde slit rows are offset; i) when said transversal is extended in any direction, and thus intersects the essentially parallel centerlines of the adjacent rows, the center point of a tilde-slit will coincide with the intersection of the transversal with every essentially parallel centerline.

3. The envelope construct of claim 1, wherein said envelope is formed having up to twelve (12) or more expanded and/or planar sheet layers to create a very soft package.

4. The envelope construct of claim 1, wherein said envelope is formed having a plurality of tilde matrix layers forming said tilde matrix core, said tilde matrix layers alternating with said planar layers in a consistent or variable array to create a layered, padded shield.

5. The envelope construct of claim 1, wherein said envelope construct is formed as a sleeve adapted to be placed within a traditional envelope.

6. The envelope construct of claim 5, wherein said sleeve has an open top and open bottom ends.

7. The envelope construct of claim 5, wherein said sleeve has an open top end and closed side walls and a closed bottom wall.

8. The envelope construct of claim 1, wherein said envelope construct is formed as an envelope having a top opening, closed side and bottom walls, and an interior cavity.

9. The envelope construct of claim 1, wherein said envelope construct is formed as an envelope bag having a top opening, closed side and bottom walls, and an interior cavity.

10. The envelope construct of claim 1 comprising a flap for closure of said envelope construct.

11. The envelope construct of claim 1 comprising one or more partitions.

12. The envelope construct of claim 1, wherein said envelope construct is formed having over lapping seamed joint and 90° folded rails.

13. The envelope construct of claim 1 comprising one or more fold lines.

14. The envelope construct of claim 1, wherein said web material comprises curved centerlines of and said plurality of essentially parallel rows of tilde-slits are parallel to the longitudinal direction.

15. The envelope construct of claim 14, wherein said web material comprises two regions, wherein: a) each region is located at an opposite edge; b) each region has a regional width along the width direction of the web material; c) each region has an edge that is coincident with the edge of the web material; d) each region extends in the longitudinal direction along the entire longitudinal dimension; and e) neither region contains tilde-slits.

16. The envelope construct of claim 1, wherein said web material comprises straight linear centerlines and said plurality of essentially parallel rows of tilde-slits are parallel to the longitudinal direction.

17. The envelope construct of claim 1, wherein said web material is produced from a material taken from the group consisting of plastic webbing, paper, cardboard, resinous material, fibrous material, and metal.

18. The envelope construct of claim 1, wherein said the center portions of the tilde-slits are not perpendicular to the end portions.

19. The envelope construct of claim 1, wherein said each unexpanded tilde-slit further consists essentially of two curves that each connect an end portion to the center portion, wherein the two curves are double reversed mirror images of one another, such that the tilde-slit becomes continuously formed by joining one end portion to one curve, and that one curve to the center portion, and the center portion to the second curve, and the second curve to the second end portion.

20. An envelope constructed formed having at least two sheet layers and a tilde matrix core placed between said sheet layers, said tilde matrix core being flat planar formable surface that is able to hold a set having thru cuts that are off-angle to their longitudinal direction while maintaining a curved or straight centerline on the mid-section of the cut that is aligned as a curved or straight transversal at an angle greater than 90 degrees with respect to the longitudinal direction and will only deform into a three dimensional structure that is essentially flat having substantially square or rhombi or diamond shaped cells or cubicles that are formed by opening and folding of the formable surface and are attached at their corners in the x and y axis while concurrently these cells when being born are attached to longitudinal rails having peaks and valleys that are off angle to the horizontal plane so that said cells can only be opened to the limitation of a predetermined precut structure by applying a force to said planar surface thus opening the cells into an array.

* * * * *